US005335312A

United States Patent [19]

Mekata et al.

[11] Patent Number: 5,335,312

[45] Date of Patent: Aug. 2, 1994

[54] NOISE SUPPRESSING APPARATUS AND ITS ADJUSTING APPARATUS

[75] Inventors: Tsuyoshi Mekata, Katano; Hideyuki Takagi, Kyoto, both of Japan

[73] Assignee: Technology Research Association of Medical and Welfare Apparatus, Tokyo, Japan

[21] Appl. No.: 940,499

[22] Filed: Sep. 4, 1992

[30] Foreign Application Priority Data

Sep. 6, 1991 [JP] Japan ..... 3-226984

[51] Int. Cl.[5] ..... G10L 3/02

[52] U.S. Cl. ..... 395/2.11; 395/2.35

[58] Field of Search ..... 395/2, 2.11, 2.35, 2.36, 395/2.41

[56] References Cited

PUBLICATIONS

Kroschel, K, "Methods for Noise Reduction Applied to Speed Input Systems," Proc. VLSI and Computer Peripheral, vol. 2, pp. 82–87, IEEE, 1989.

Anderson B et al., "A Method for Noise Filtering with Feed-Forward Neural Networks: Analysis and Comparison with Low-Pass and Optimal Filtering," Int'l Joint Conference on Neural Networks, vol. 1, pp. 209–214, IEEE, 1990.

*Primary Examiner*—David D. Knepper

*Attorney, Agent, or Firm*—Ratner & Prestia

[57] ABSTRACT

The adjustment of a noise suppressing apparatus inputs the voice signal with the noises being piled up in it to decide the weight coefficient of the neutral network 130 with a back propagating method so that the errors of the output signal and of the noiseless signal may become minimum, the noise suppressing apparatus where noises in a voice signal are suppressed even in a situation where the positional relation between the noise source and the voice source may often change, and noises offensive to the voice after the noise suppression may not remain, the suppressing effect is not deteriorated even if the time pattern of the input signal is varied.

14 Claims, 21 Drawing Sheets

NOISE SUPPRESSING APPARATUS AND ITS ADJUSTING APPARATUS

BACKGROUND OF THE INVENTION

The present invention generally relates to a noise suppressing apparatus for suppressing noises piled up on signals so as to output a signal whose noises are suppressed, and its adjusting apparatus.

A plural mike method, a maximum likelihood noise estimating method, a spectrum subtracting method and so on are provided for the conventional noise suppressing apparatus. The plural mike method is adapted to multiply a signal from each mike by a constant coefficient so as to effect an addition, with the use of a fact that strength differences among signals and noises to be detected with mikes provided in the different positions are different for each of the mikes, for suppressing the noises. In the rough noise estimating method, the average amplitude and dispersion of the noises for each frequency band are calculated by the observation of the noises so as to decide the threshold value of the noise section judgment. Thereafter, upon the inputting operation of the voice with noises being piled up in it, only the voice section exceeding the threshold value is outputted as the signal output. In the spectrum subtracting method, the noise signal spectrum registered in advance from the spectrum of the input signals is subtracted, and thereafter is converted into the voice signal.

It is also reported that a neutral net is used as in the description by Shin-ichi Tamura, Andreks . Wivel: "Noise suppression by waveform input, output using a neutral network" (Shingaku art process Vol. 87, NO. 351, pp. 33–37, January 1988). FIG. 21 is a block diagram of the conventional noise suppressing apparatus. Reference numeral 10 is an input terminal, reference numeral 20 is a buffer memory for storing the input signal data for time length portion of 5 ms. Reference numeral 30 is a four-layer neutral network. Reference numeral 40 is an input layer, reference numeral is a hidden layer, reference numeral 60 is an output layer. Reference numeral 70 is a buffer memory for storing, retaining the output signals of the neutral network. Reference numeral 80 is an output terminal where the data of the buffer memory are sequentially read, outputted.

In the conventional noise suppressing apparatus constructed as described hereinabove, voice signals with noises being piled upon them are inputted from the input terminal, and are stored in the buffer memory 20 of the time length portion of 5 ms. The respective sample data stored are transferred to the respective units of the input layer 40 of the neutral network 30. The neutral network 30 represents voices with noises of 5 ms length being piled up in them on the voice waveform data of 5 ms length with noises being suppressed so as to output them to the buffer memory 70. The data are sequentially read, and are outputted to the output terminal 80 as the voice waveform data after the noise suppression. The learning (determination of a weight coefficient) of the neutral network is effected by a back propagation so that the voices with noises being piled upon them are inputted to the neutral network, and the square total of the difference between the same voice of the noiseless sound and the output signal may become minimum.

The plural mike method had a problem that voices were suppressed inversely when the positional relationship between the noise source and the voice source changed. The maximum likelihood noise estimating method and the spectrum subtracting method had modulated noises in the voice section left with a problem in the natural degree of the voice after the noise suppression. In a system where the time waveform of the input signal was inputted as it was into the neutral net, there was a problem in that the suppressing effect was deteriorated when the voice time pattern of generating speed and so on changed, because the time waveforms with noises being piled up in them were directly represented in the time waveforms with the noises being suppressed in them.

SUMMARY OF THE INVENTION

Accordingly, the present invention has been developed with a view to substantially eliminating the above discussed drawbacks inherent in the prior art, and has for its essential object to provide an improved noise suppressing apparatus and its adjusting apparatus.

Another important object of the present invention is to provide a noise suppressing apparatus for compressing noises even in a situation where the positional relationship between the noise source and the voice source may often change, a noise suppressing apparatus where noises offensive to the voices after the noise suppression may not remain, a noise suppressing apparatus where the suppressing effect is not deteriorated even if the time pattern of the input signal is varied.

The noise suppressing apparatus of the present invention is provided with a frequency band dividing mans for dividing into a plurality of frequency bands a signal with noises being piled up on it, a neutral network having an input layer composed of units connected with the respective output terminals of the above described frequency band dividing means, a hidden layer composed of a plurality of units with the respective units being connected with a plurality of input layer unit layers, and an output layer of a single unit connected with the respective intermediate units so as to obtain output signals with noises being suppressed from a single unit of the output layer of the neutral network.

An adjusting method of the present invention comprises a noiseless sound signal generating means for generating noiseless sound signals, a means for piling up noises on the noiseless sound signal, a noise suppressing apparatus described in the scope of the claims, a weight coefficient renewing means for renewing the weight coefficients of the neutral network the above described noise suppressing apparatus has by a back propagating method so that the error from a teacher signal may become small with the output signal of the above described noiseless sound signal voice producing means being provided as a teacher signal input, the output signal of the above described noise suppressing apparatus being inputted, an error computing means for computing, outputting an average error between the output signal of the above described noise suppressing apparatus and the output signal of the above described noiseless sound signal voice producing means, an adjustment completion judging means for suspending the operation of the above described weight coefficient renewing means when the computed error has become lower than an established threshold value or when the reduction of the error has been focused, to make optimum the weight coefficients of the above described neutral network of the above described noise suppressing apparatus at the adjustment completion time.

In the invention, first, the input voice signal with noises being piled up on it is divided in frequency band by the above described construction, the signal for each frequency band is represented on the voice signal of the noiseless sound for each frequency band with the neutral network, so that the signal of the frequency band necessary for the transfer of the voice is automatically emphasized and the frequency band more in the noise components is automatically suppressed.

In the present invention, with the above described construction, the weight coefficient of the neutral network with which the noise suppression is made maximum by the noise suppressing apparatus of the present invention can be set automatically with the back propagating method.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
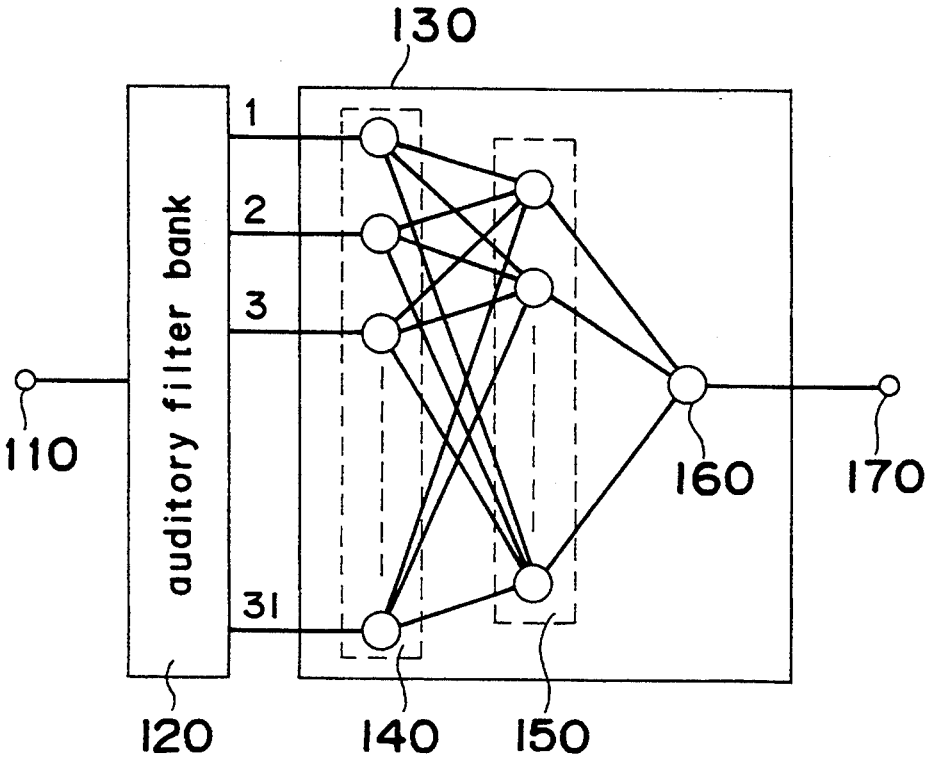
FIG. 1 is a block diagram showing the construction of a noise suppressing apparatus in a first embodiment of the present invention.

Before the description of the present invention proceeds, it is to be noted that like parts are designated by like reference numerals throughout the accompanying drawings.

FIG. 1 shows a block diagram of a noise suppressing apparatus in a first embodiment of the present invention. In FIG. 1, reference numeral 110 is an input terminal. Reference numeral 120 is a LION type of auditory sense filter bank of 31 channels for dividing the signals of 1 through 16 Bark frequency bands with the central frequency for each 0.5 Bark in accordance with the auditory sense characteristics. A neutral network 130 is a feed forward type neutral network of 31 units in an input layer 140, 10 units in a hidden layer 150, 1 unit in an output layer 160. The respective units of the input layer 140 are coupled to the respective units of the hidden layer 150. The respective units of the hidden layer 150 is coupled to the unit of the output layer 160. Reference numeral 170 is an output terminal.

Figure 2:
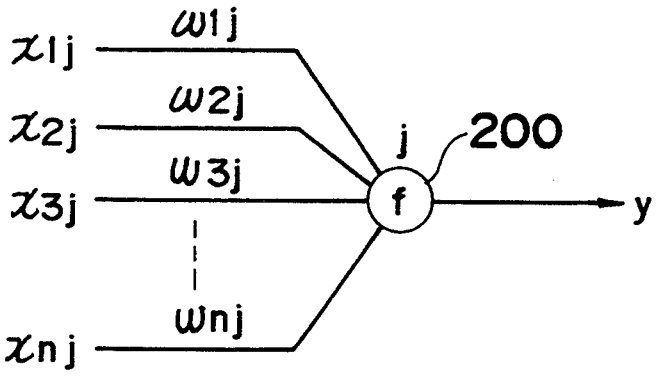
FIG. 2 is a view showing a calculation example of each unit.

A noise suppressing apparatus in the embodiment constructed as hereinabove described will be described hereinafter in its operation. The input signal inputted into the input terminal 110 is divided into a plurality of frequency bands with an auditory filter bank 120 and is inputted into each unit of the input layer 140 of the neutral network 130. The operation example of each unit in the neutral network is shown in FIG. 2. Inputs Xlj through Xnj are inputted into the unit 200 in the form of a load total multiplied with weight coefficients Wlj through Wnj respectively. The output of the unit 200 is as follows.

(Numerical Equaiton 1)

$$y = f\left(\sum_{i=1}^{n} WijXij + \theta\right)$$

Figure 3A:
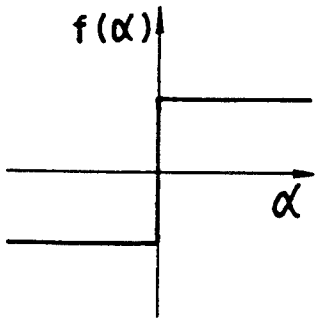
FIGS. 3(*a*)–(*c*) are views showing an example of a function f(α)
Figure 3B:
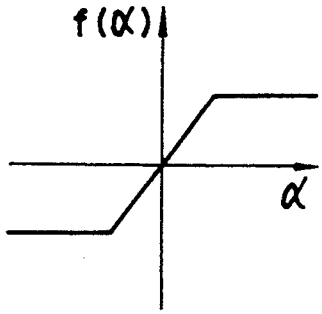
Figure 3C:
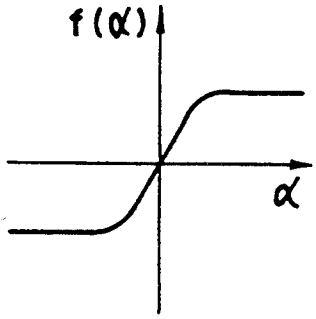

An example of a function f(α) is shown in FIG. 3(*a*), (*b*), (*c*). Such operation as described hereinabove is effected in a hidden layer 150, an output layer 160. Set all the weight coefficients Wij properly with such a method as described later with FIG. 4 and the output signal to be generated in the output terminal 170 emphasizes the voice so as to suppress the noises. As the coefficient of the neutral network 140 does not change during the signal processing operation, the gain of each frequency band does not change abruptly, so that the noise suppressing apparatus does not cause such unnatural distortion as in a spectrum subtraction method. The noises can be suppressed even if the generating speed is changed so long as the parameters of the voice on the frequency axis such as formant and pitch do not change.

According to the present embodiment, a noise suppressing apparatus where unnatural distortion is not caused even in the single input by the combination of the filter bank and the neutral network.

Figure 4:
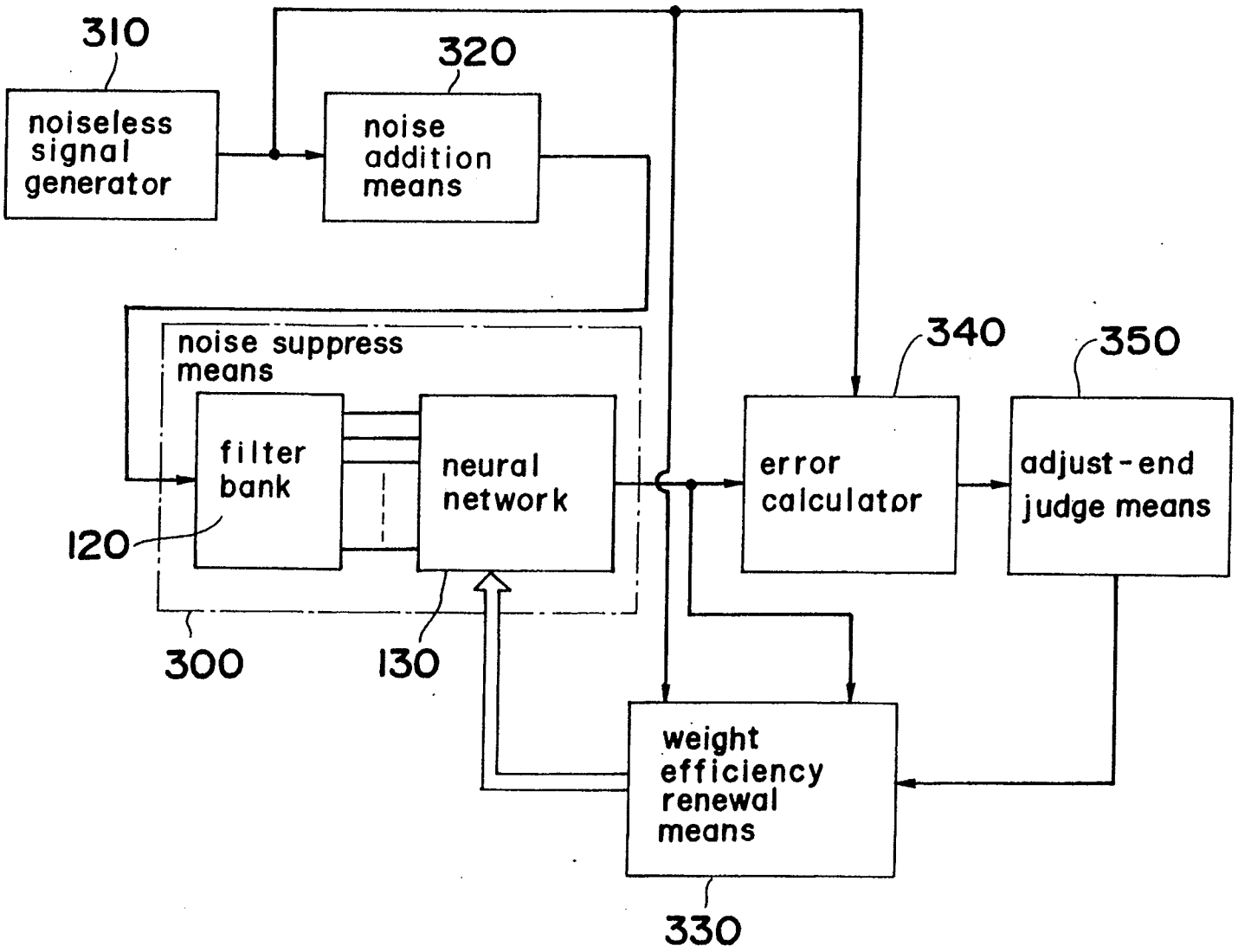
FIG. 4 is a block diagram showing the construction of an adjusting method of a noise suppressing apparatus in a second embodiment of the present invention.

A block diagram of an adjusting method of a noise suppressing apparatus in the second embodiment of the present invention will be shown in FIG. 4. The processing procedure thereof will be described in FIG. 5. The present embodiment inputs the voice signals with noises being piled up on them into a noise suppressing apparatus so as to decide the weight coefficients of the neutral network 140 of the noise suppressing apparatus in the first embodiment with a back propagating method with the noiseless voice as a target. Like parts in FIG. 4 are designated by like reference numerals in FIG. 1. Reference numeral 300 is a noise suppressing apparatus shown in the embodiment of FIG. 1. Reference numeral 120 is a 31 cH auditory filter bank, reference numeral 130 is a neutral network of 31 units in an input layer 31, 10 units in a hidden layer, 1 unit in an output layer. Reference numeral 310 is a noiseless sound signal source for generating the voice s (t) ($0 \leqq t \leqq T$) of noiseless, time length T, reference numeral 320 is a noise addition means for piling up on an input signal a noise signal which becomes an object of the suppression. Reference numeral 330 is a weight coefficient renewing means for calculating by a back propagation method the weight coefficients of the neutral network 130 so that the average error between the output signal of the neutral network 130 and the time T of the output signal of the noiseless sound signal generating means so as to renew them. Reference numeral 340 is an error computing means for calculating the average error between the output signal of the neutral network 130 and the time T of the output signal of the noiseless sound signal generating means. Reference numeral 350 is an adjustment completion judging means for suspending the operation of the above described weight coefficient renewing means when the computed average error has become lower than the established threshold value or when the reduction in the error has been focused.

Figure 5:
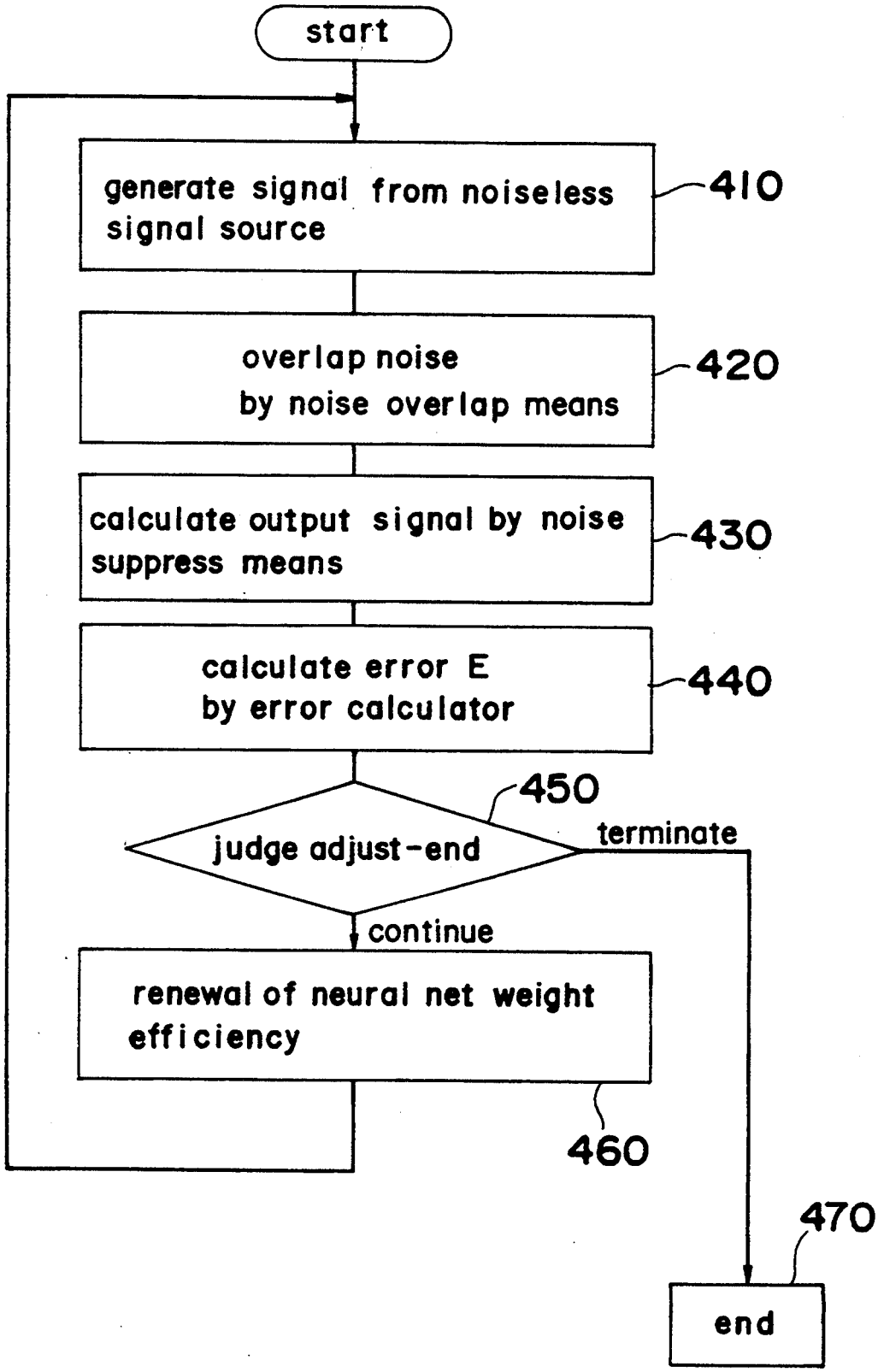
FIG. 5 is a block diagram showing the processing flow of an adjusting method of a noise suppressing apparatus in a second embodiment of the present invention.

A procedure of the adjusting method in the embodiment constructed as described hereinabove will be described with the use of FIG. 5. The noiseless sound signal from the noiseless sound signal source 310 will be generated (410). The noise less sound signal is set by the noise addition means 320 so that an average S/N ratio within the voice section of the time length T of the noiseless sound signal becomes, for example, 6 dB, and the voice is inputted into the noise suppressing apparatus 300 (420)). The weight coefficient of the neutral network 140 of the noise suppressing apparatus is set into a proper initial value, and the voice with the noises being piled upon it is processed with the use of the weight coefficient so as to calculate the output signal 0 (t) (430). The error means 340 calculates such error E as shown in the following equation with the use of the output signal of the noise suppressing apparatus 300 and the noiseless voice. The error E is transferred to the adjustment completion judging means 350.

$$E = \sum_{i=0}^{T} (O(t) - s(t))^2 \qquad \text{(Numerical Equation 2)}$$

The adjustment is completed when the adjustment completion is judged (450) by the adjustment completion judging means (470). The new weight coefficient is generated in the weight coefficient renewing means 330, when the adjustment is not completed, to transfer the adjustment to the neutral network 130 of the noise suppressing apparatus 300.

Similar processing is repeated hereinafter. The adjustment completion judging means repeats the above described operation till the judgment of the adjustment completion from the error computation result.

According to the present embodiment, the voice signal with noises being piled up on it is inputted into the noise suppressing apparatus so as to decide the weight coefficient of the neutral network 130 of the noise suppressing apparatus in FIG. 1 with a back propagating method with the noiseless voice as a target so that the weight coefficient of the noise suppressing apparatus of FIG. 1 can be set without complicated calculation on the side of the user.

Figure 6A:
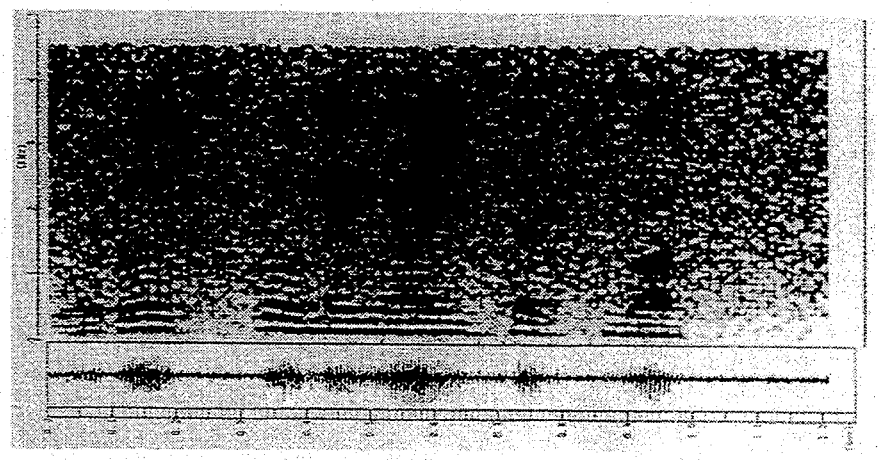
FIGS. 6(*a*)–(*b*) are views showing an example of a noise suppressing effect of the noise suppressing apparatus in a first embodiment adjusted by an adjusting method in the second embodiment.
Figure 6B:
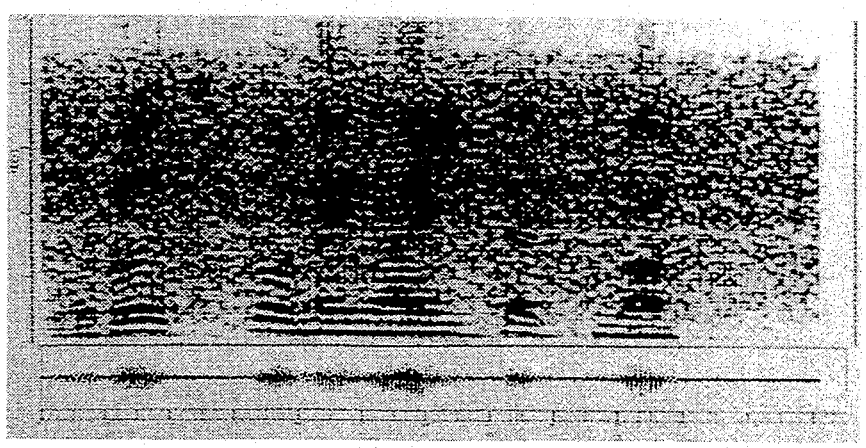

An example of the noise suppressing effect of the noise suppressing apparatus in the first embodiment adjusted with the adjusting method of the second embodiment is shown in FIG. 6. FIG. 6(*a*), (*b*) are respectively a time waveform and a spectrogram of a Japanese voice before and after the processing. White noises are added to be the signal before the processing, and the noises are piled up so that it may become the S/N ratio 6 dB upon five vowels to be provided from the other words at the decision time of the weight coefficient so as to provide the input signal. As compared with FIG. 6(*a*), (*b*), as is clear, the components of the voice buried in the noises of 2 kHz or more appear on the spectrogram clearly by the processing. As is clear from the time waveform, the noises of approximately 10 dB are suppressed. Such unnatural distortion as when the spectrum subtraction was used cannot be heard in the voice after the processing.

In order to effect a quantitative appraisal, the appraisal of the noise improvement degree is effected with the use of a spectrum distortion SD and a spectrum distortion improvement degree IM to be defined with the following equation.

$$SD = 10 \log \frac{\Sigma |fs(i)|^2}{\Sigma |fd(i) - fs(i)|^2} \qquad \text{(Numerical Equation 3)}$$

wherein fd: spectrum of a signal including distortion and noises fs: spectrum of a signal including no distortion and no noises Numerical Equation 4

IM=[SD of output signal]−[SD of input signal].

Figure 7:
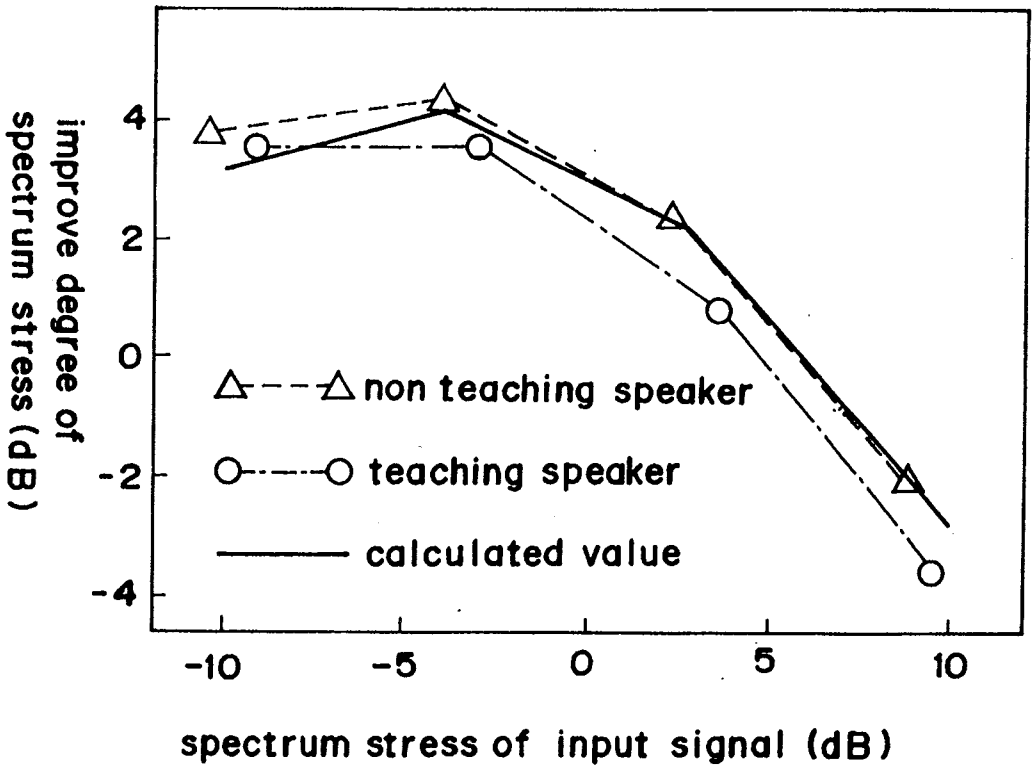
FIG. 7 is a chart showing a spectrum distortion improvement degree IM in the input signal voice section obtained with respect to 67 Japanese mono-syllable words.
Figure 8A:
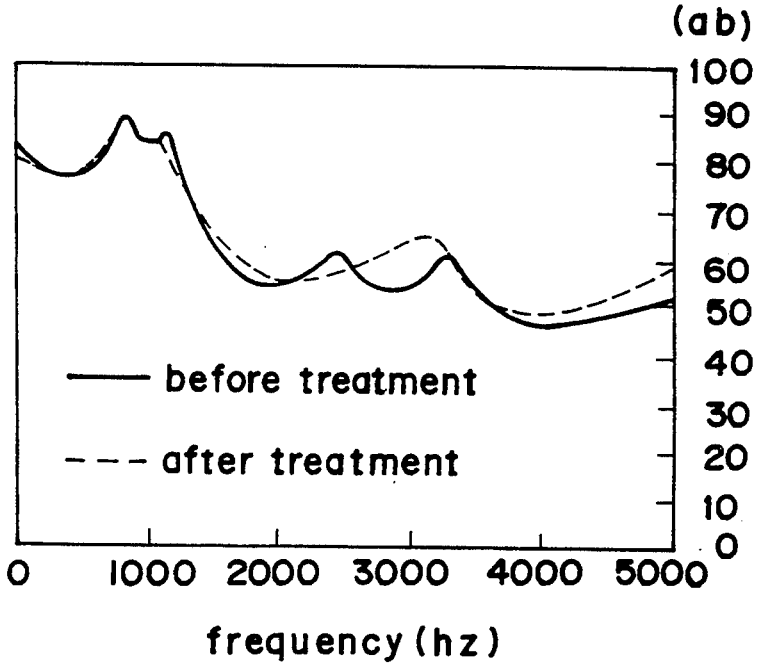
FIGS. 8(*a*)–(*e*) show charts showing results where a LPC spectrum of a steady portion in a vowel sound is compared with before and after the processing.
Figure 8B:
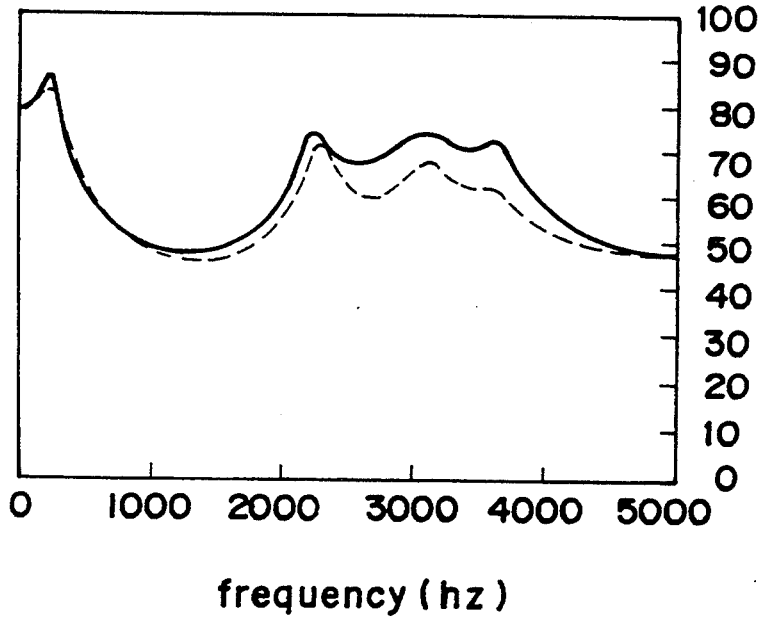
Figure 8C:
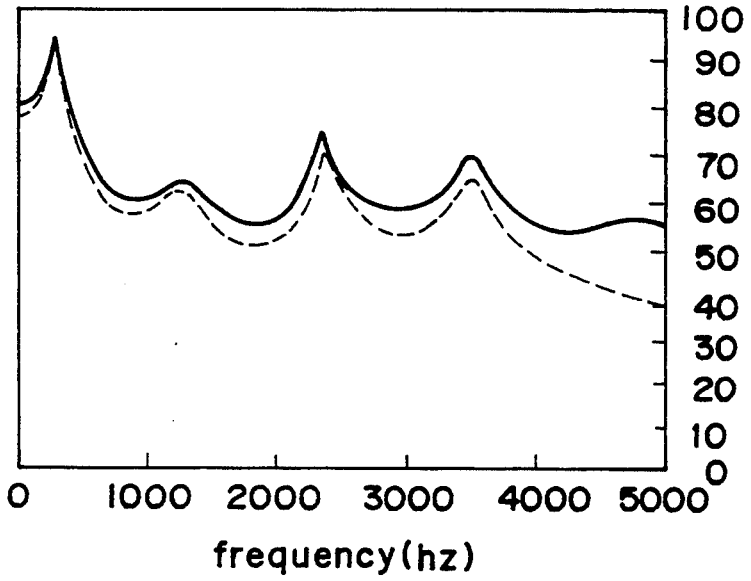
Figure 8D:
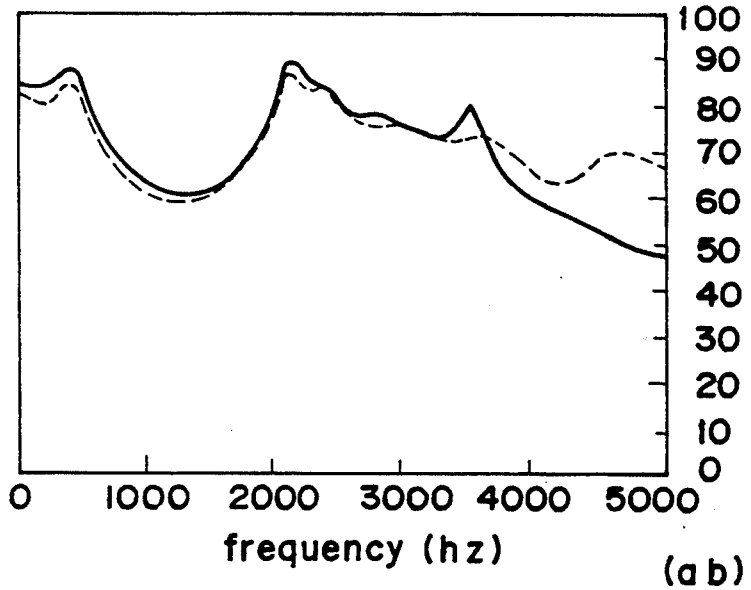
Figure 8E:
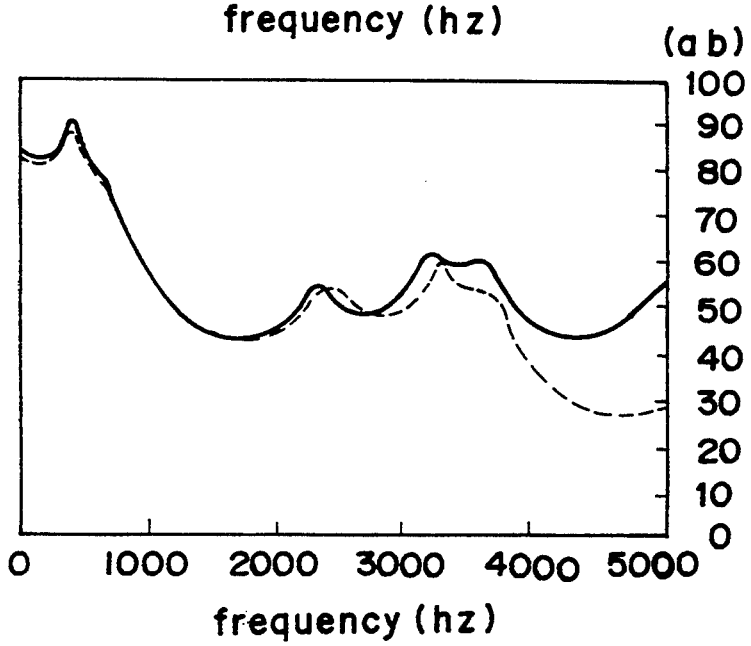

FIG. 7 shows a spectrum distortion improvement degree IM of the input signal voice section obtained with respect to Japanese word 67 signal syllables except for a contracted sound. In order to check the effects of the learning, the respective results of the male's voice and the another male's voice used for the learning are shown. In a region of −4 dB or lower in the spectrum distortion of the input signal, the noises of approximately 4 dB are suppressed. As the noises in the input voice becomes less, a spectrum distortion improving effect becomes less by the distortion to be caused by the processing and the trade off of the noise suppression effect. In order to investigate the quality of the distortion to be caused by the processing, noiseless sound single syllable data of five vowels are processed with the present model so as to compare, before and after the processing, the LPC spectrum of the steady portion. FIG. 8 shows the results. Effects for emphasizing the contrast of the LPC spectrum, namely, the formant emphasizing effect can be confirmed except for a case where the distance of formants is extremely near-by as in F1 and F2 of /a/.

The noise suppressing apparatus in the first embodiment adjusted by the adjusting method in the second embodiment as described hereinabove suppresses noises without causing unnatural distortion. If the noiseless voices are processed with the use of the noise suppressing apparatus, the formant can be emphasized.

Figure 9:
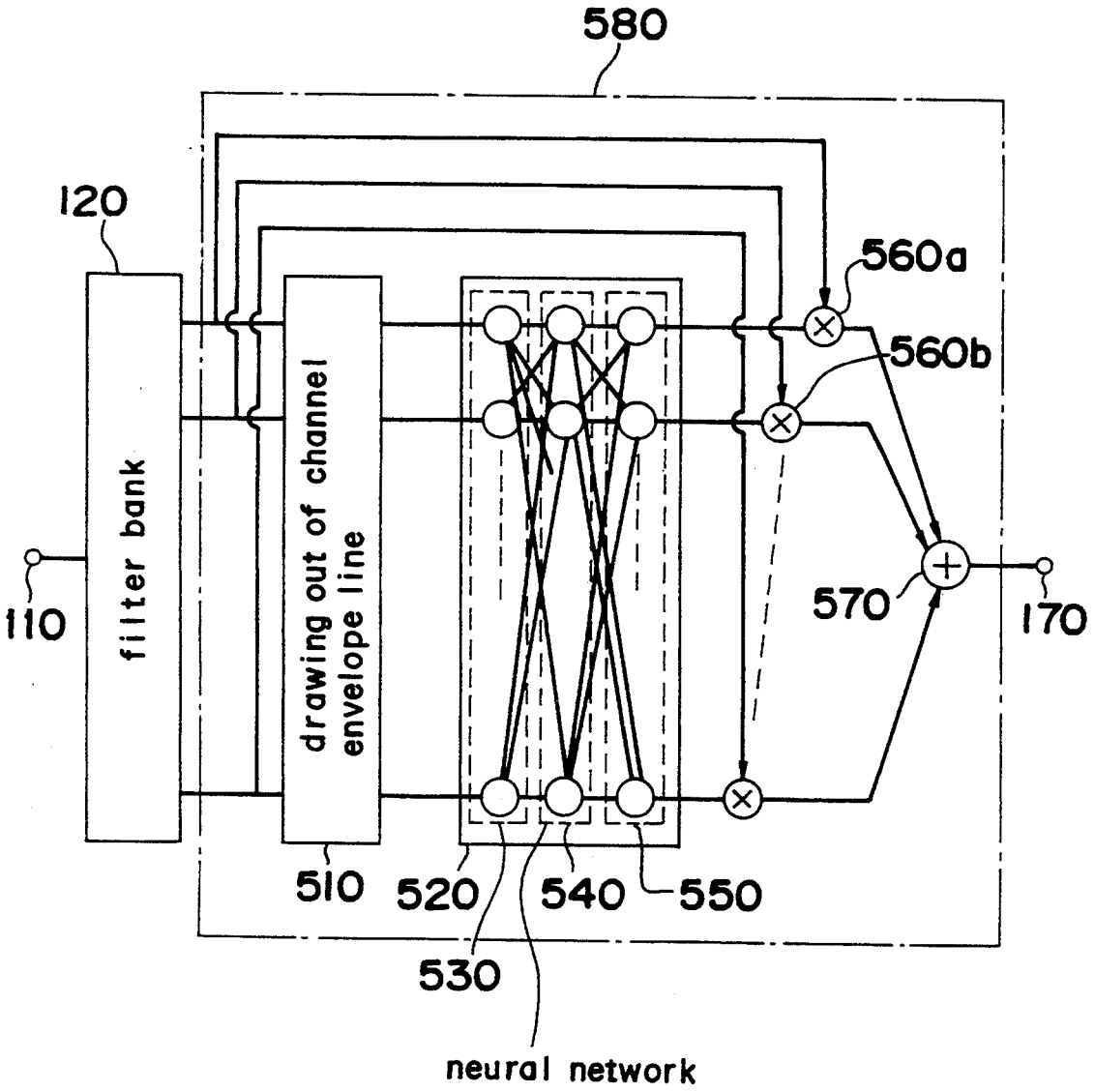
FIG. 9 is a block diagram showing the construction of a noise suppressing apparatus in a third embodiment of the present invention.

FIG. 9 shows the block diagram of the noise suppressing apparatus in a third embodiment of the present invention. It is to be noted that like parts in FIG. 9 are designated by like reference numerals in FIG. 1. Reference numeral 110 is an input terminal, reference numeral 120 is an auditory filter bank of 31 channels where the input signal is divided into a plurality of frequency band signals in accordance with the auditory characteristics, reference numeral 170 is an output terminal. Reference numeral 510 is an envelope extracting means of each frequency band for detecting the wave of a signal divided into each frequency band. The wave detector means can be composed of a rectification and a low-pass passing shaped filter. Neutral network 520 is a feed forward type of neutral network of 31 units in an input layer 530, 31 units in a hidden layer 540, 31 units in an output layer 550. All the input layers and all the hidden layers, all the hidden layers and all the output layers are coupled. Reference numerals 560*a*, 560*b*, are multipliers. Reference numeral 570 is an adder. Also, reference numeral 580, as a matter of convenience for illustration of the later embodiment, is referred to as a noise suppression processing portion.

The noise suppressing apparatus in the embodiment constructed as described hereinabove will be described hereinafter in its operation. The input signal inputted into the input terminal 110 is converted into 31 frequency bands with an auditory filter bank 120. The signal of each frequency band has the envelope information extracted with an wave detector means 510. The neutral network 520 represents the envelope information on the gain necessary in each frequency band for suppression of the noises so as to output it. The gain of each region outputted from the neutral network is multiplied with a signal of each frequency band and multipliers 560*a*, 560*b*, so as to calculate the total of the signals of all the frequency bands by the adder 570 and output it into the output terminal 170. When the weight Wij of each layer of the neutral network 520 is set properly with a method of FIG. 4 or with a method to be described with the description of FIG. 9 later, the output signal to be generated at the output terminal 170 emphasizes the voice so as to suppress the noises. The weight coefficients of the neutral network 520 are set with the adjusting method of FIG. 4 or an adjusting method of FIG. 10 to be described later. The noise suppressing apparatus can effect a thinning out learning at the determination time of the weight coefficient as described later to determine the gain of each frequency band in accordance with the envelope information less in time variation, and does not take time in the optimum determination of the weight coefficient as compared with the noise suppressing apparatus in the first embodiment.

According to the present embodiment, a noise suppressing apparatus which can make the weight coefficient of the neutral network optimum with a short time can be obtained with the combination of the filter bank, the envelope extracting means and the neutral network.

Figure 10:
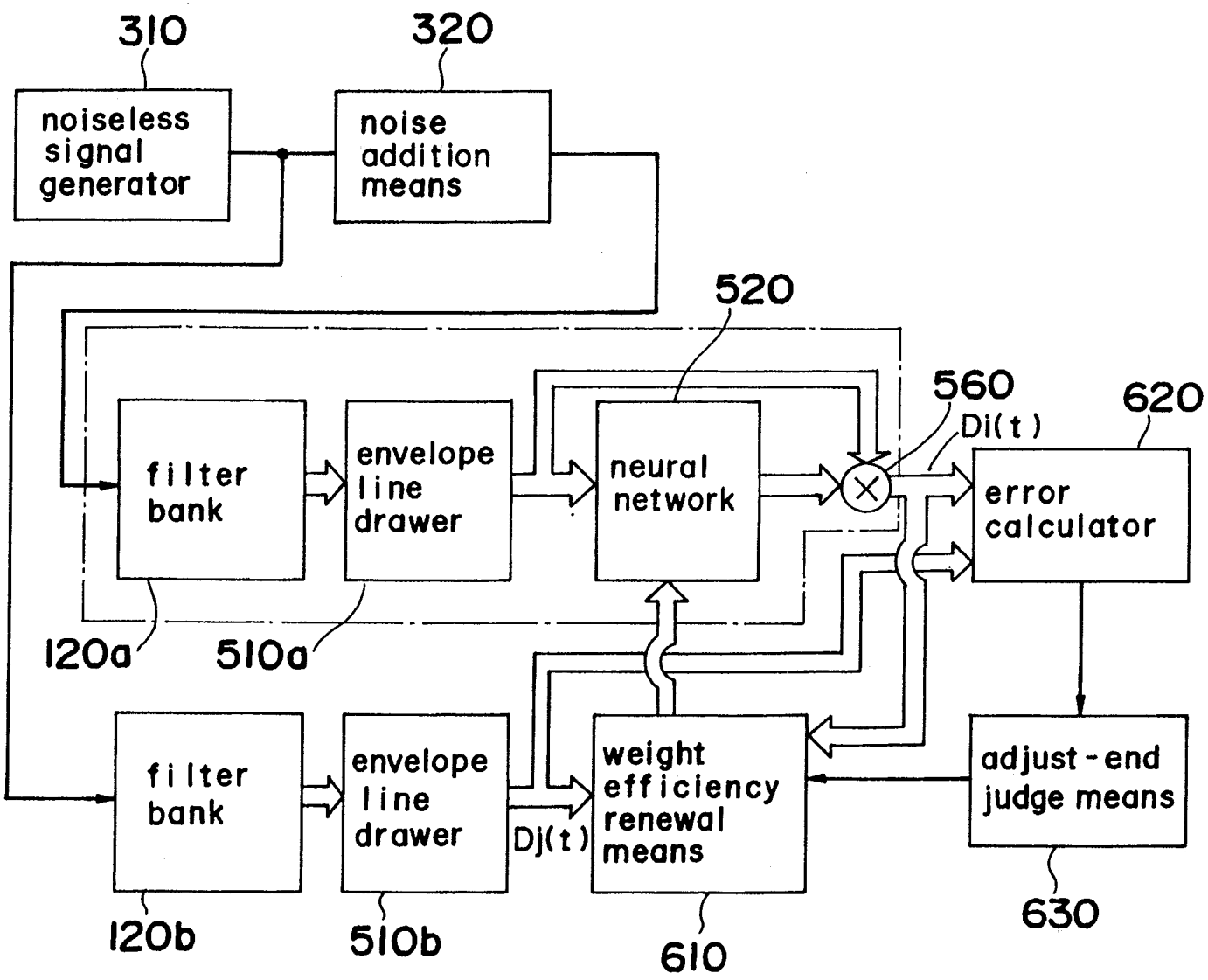
FIG. 10 is a block diagram showing the construction of an adjusting method of a noise suppressing apparatus in a fourth embodiment of the present invention.
Figure 11:
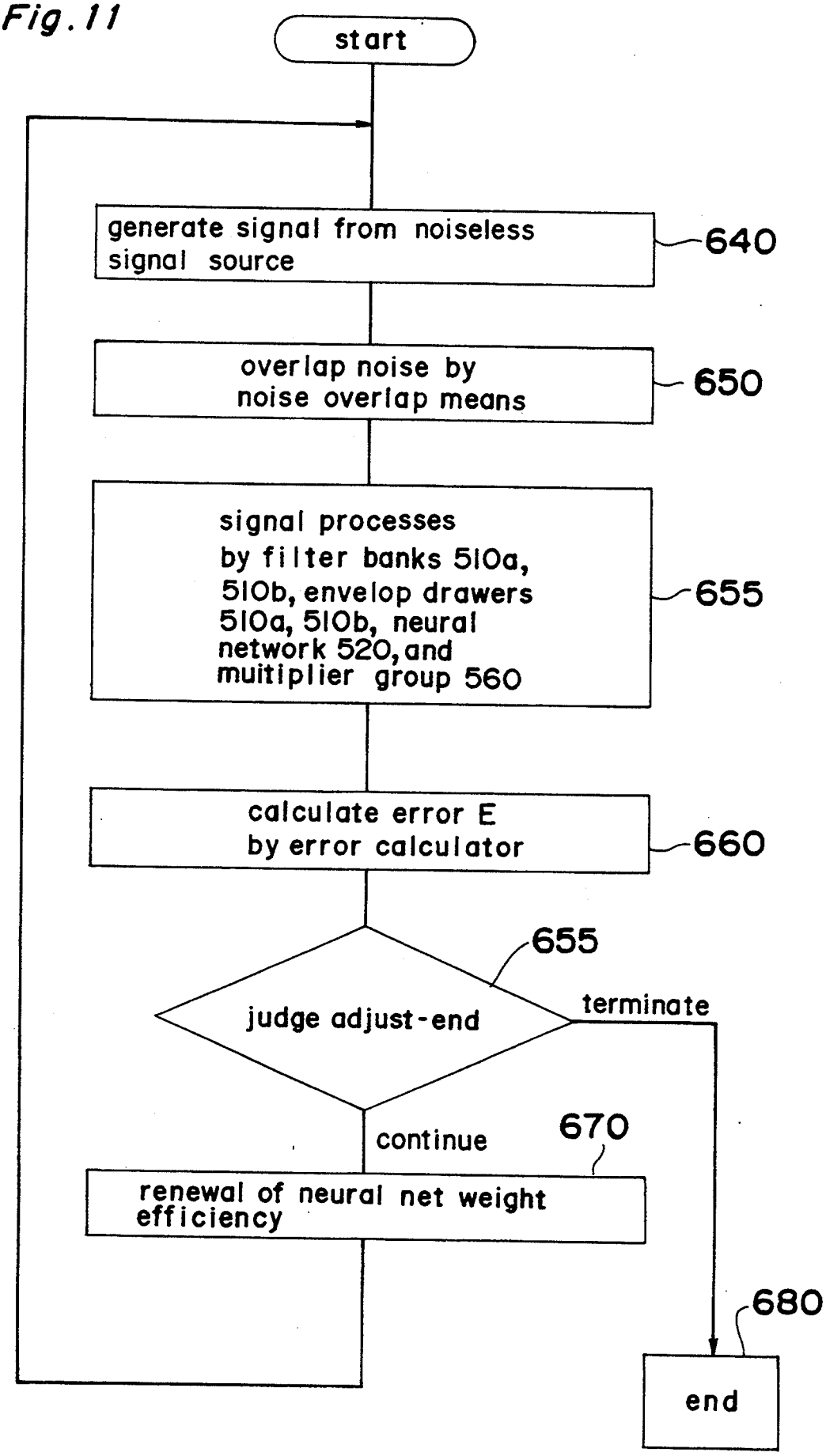
FIG. 11 is a block diagram showing the processing flow of an adjusting method of a noise suppressing apparatus in the fourth embodiment of the present invention.

FIG. 10 shows a block diagram of an adjusting method of the noise suppressing apparatus of FIG. 9 in the fourth embodiment of the present invention. FIG. 11 shows a flow chart of the processing. It is to be noted that like parts of FIG. 10 are designated by like reference numerals in FIG. 4, 9. The present embodiment decides the weight coefficients of the neutral network 520 of the noise suppressing apparatus of FIG. 9. Referring to FIG. 10, reference numerals 120*a*, 120*b* are respectively the same auditory filter bank as the auditory filter bank 120 of FIG. 9, reference numerals 510*a*, 510*b* are respectively the same as the wave detector 510 of FIG. 9. Reference numerals 520 is a neutral network. Reference numeral 560 is a multiplier group for calculating the product of the output signal of the filter bank 120*a* and of the output signal of the neutral net 520 for each frequency band. Reference numeral 310 is a noiseless sound signal source for generating the voice s (t) ($0 \leqq t \leqq T$) of noiseless sound, limited time length T, reference numeral 320 is a noise addition means for piling up on an input signal the noise signal which becomes an object of the suppression. Reference numeral 610 is a weight coefficient renewing means for calculating, renewing by a back propagation method the weight coefficients of the neutral network 130 so that the average at the time T of the error for each frequency band between the output signal of the multiplier group 560 and an output signal of the envelope extracting means 510*b* may become smaller. Reference numeral 620 is an error computing means for calculating the average at the time T of the error for each frequency band between the output signal of the multiplier group 560 and the output signal of the wave detector means 510*b*. Reference numeral 630 is an adjustment completion judging means for suspending the operation of the above described weight coefficient renewing means when the computed average error has become lower than the established threshold value or when the reduction in the error has been focused.

The processing flow of the adjusting method in the embodiment constructed as described hereinabove will be described with the use of FIG. 5. The noiseless sound signal source 310 generates the noiseless sound signals (640). The noises are piled up so that the average S/N ratio of the voice of the time length T generated by the noiseless sound signal generating means 310 may become, for example, 6 dB (650). The signal with noises being piled up in it is inputted into a filter bank 120*a*, and the envelope of each frequency band signal is extracted by the wave detecting means. The weight coefficients of the neutral network 520 is set to an proper initial value, and the voice with the noises being piled up in it is processed with the weight coefficient so as to obtain the output signal. The output of the numeral network 520 and the signal of each frequency band after the wave detection are multiplied respectively by a multiplier 630 so as to obtain a signal Qj (t) corresponding to the envelope after the noise suppression of each frequency band. The voice signal of the noiseless sound is inputted into a filter bank 120*b* so as to detect the wave Pj (t) of each frequency band of the noiseless sound voice. (j is a number of the frequency band). The error means 620 calculates such an error E as shown in the following equation with the use of the Pj (t) and the Qj (t) so as to transfer the error E to the adjustment completion judging means 630.

$$E = \sum_{i=0}^{T} \sum_{j=1}^{m} (Qj(t) - Pj(t))^2 \qquad \text{(Numerical Equation 5)}$$

The adjustment completion Judging means 630 effects the judgment of the adjustment completion (655). When the completion has been judged, the adjustment is completed (680). When the completion has not been judged, the weight coefficient renewing means 610 calculates with the back propagation method the new weight coefficients of the neutral network 520 so as to renew the weight coefficients so that the error for each j between the time $0 \leqq t \leqq T$ of the Qj (t) and the Pj (t) (670) may become smaller.

Through the repetition of the above described operations till the judgment of the adjustment completion from the error computation results by the adjustment completion judging means, the weight coefficients of the noise suppressing apparatus in the embodiment of FIG. 8 is adjusted to become optimum. As the envelope information is less in variation in terms of time, the total may be provided by the thinning out operation the input signals for weight coefficient renewing means 610 and error means 620 can be downsampled for several tens of times. When the error calculation has been downsampled like this, the time required to the weight coefficient determination is shortened.

According to the present embodiment, the weight coefficient of the neutral network 520 of the noise suppressing apparatus in the embodiment of FIG. 8 is decided with a back propagating method as the error between the envelope information for each of frequency bands after the voice signal with noises being piled up on it has been suppressed in noise and the envelope information for each of the frequency bands of the noiseless sound voice may become minimum. The weight coefficient of the noise suppressing apparatus in the embodiment of FIG. 8 can be set without the complicated calculation on the part of a user. According to the present embodiment, the error calculation marks can be downsampled, and the weight coefficients can be calculated with a short time period.

Figure 12:
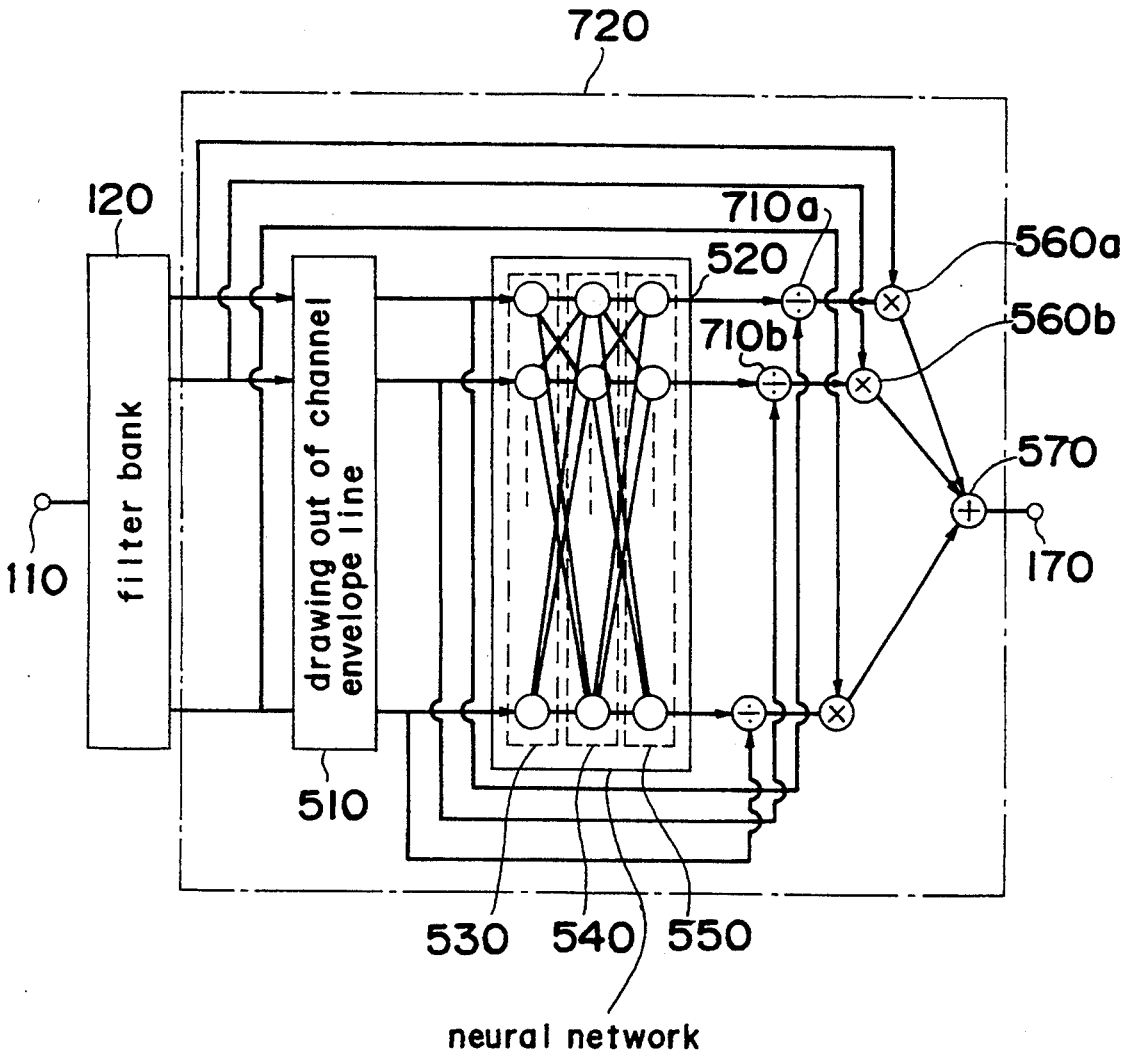
FIG. 12 is a block diagram showing the construction of a noise suppressing apparatus in a fifth embodiment of the present invention.

FIG. 12 shows a block diagram of a noise suppressing apparatus in a fifth embodiment of the present invention. In FIG. 12, it is to be noted that like parts in FIG. 12 are designated by like reference numerals in FIG. 9. Reference numeral 720 is referred to as a noise suppression processing portion for convenience in the description of the later embodiment. In FIG. 12, the output signal of the neutral network 520 is divided by a signal after the wave extraction of each frequency band so as to obtain the gain of each frequency band unlike FIG. 8.

In the noise suppressing apparatus in the embodiment constructed as described hereinabove, the neutral network 520 functions to represent on the envelope information of the voice of the noiseless sound the envelope information of each frequency band of the voice with noises being piled up upon it. In this case, the load of the neutral network becomes smaller as compared with the embodiment of FIG. 9 where the envelope information is represented on the gain of each frequency band, and the noises can be positively suppressed. The weight coefficient of the neutral network 520 of FIG. 12 is set with the use of the adjusting method of FIG. 4 and the adjusting method to be described later. As the noise suppressing apparatus decides the gain of each frequency band in accordance with the envelope information less in the time variation, the thinning out learning can be effected at the determination time of the weight coefficient as described later in the description of FIG. 13, and time is not taken in the decision of the weight coefficient as compared with the noise suppressing apparatus of the first embodiment.

As described hereinabove, according to the present embodiment, the filter tank, the wave detecting means, the neutral network for representing on the noiseless envelope information the envelope information for each of the frequency bands of the signal with noises being piled up are combined. A noise suppressing apparatus can be obtained where the weight coefficient determination of the neutral network can be effected with a short time, and the load of the neutral network itself is small.

Figure 13:
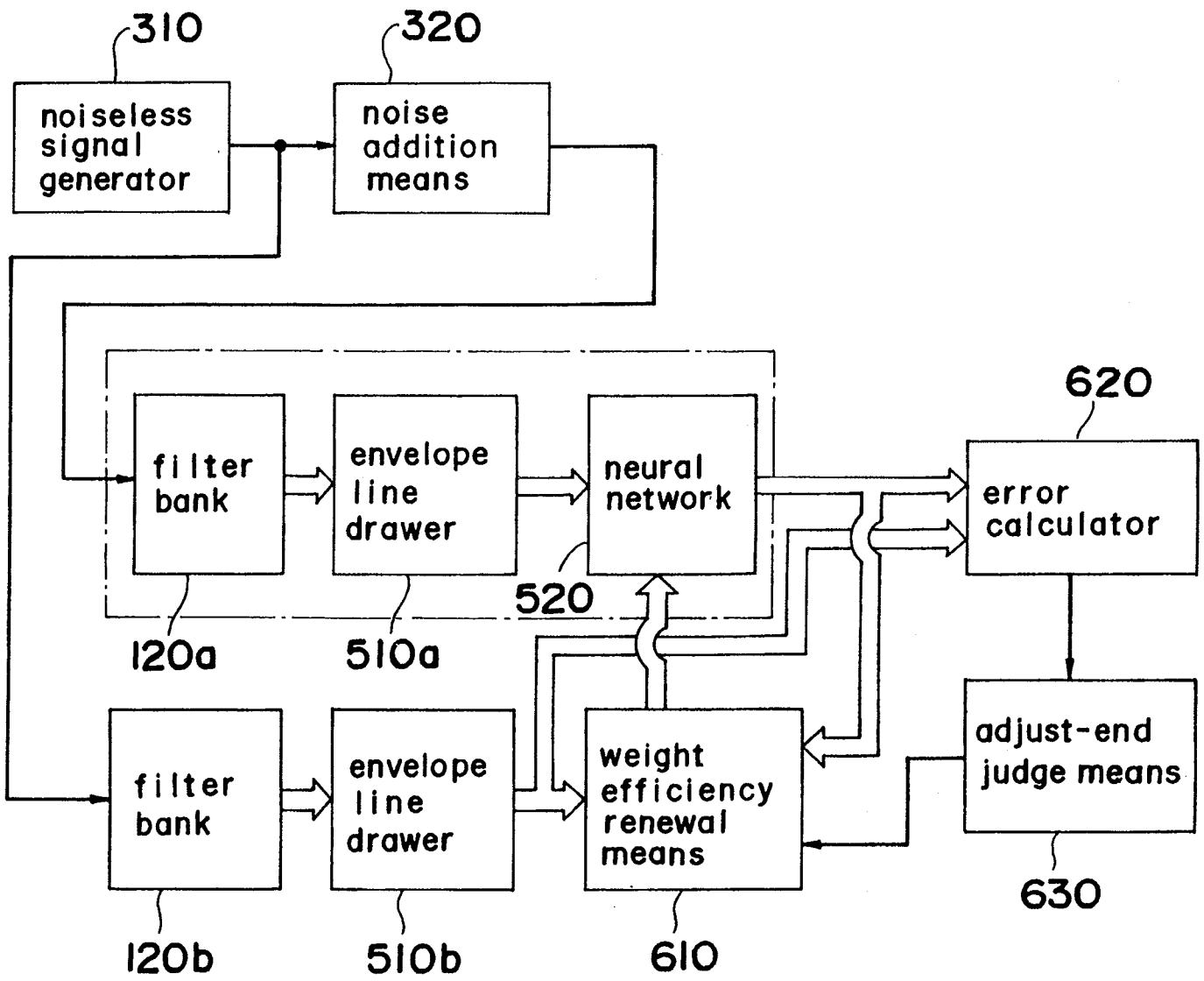
FIG. 13 is a block diagram showing the construction of an adjusting method of a noise suppressing apparatus in a sixth embodiment of the present invention.

FIG. 13 shows a block diagram of the adjusting method of a noise suppressing apparatus in the sixth embodiment of the present invention. It is to be noted that like parts in FIG. 13 are designated by like reference numerals in FIG. 10. The present embodiment decides the weight coefficients of the neutral network 520 of the noise suppressing apparatus of FIG. 12. In the adjusting method of FIG. 13, the error calculation is effected with the use of each output of the neutral network 520 and each output of the wave detector 510*a* and the weight coefficient is renewed with the back propagation method so that the error may be made minimum. The above described FIG. 13 point is different from the embodiment of FIG. 10. As the envelope information is less in time variation, the calculation of the error is not effected in all the sample points. The thinning out operation into approximate one dot in several ms through several tens of ms is effected so that the sum total may be provided. In this manner, time taken into the weight coefficient decision can be shortened when the error calculation has been downsampled.

According to the present embodiment, the weight coefficient of the neutral network 520 of the noise suppressing apparatus in the embodiment of FIG. 12 is decided with a back propagation method as the error between the envelope information for each of frequency bands after the voice signal with noises being piled up in it has been suppressed and the envelope information for each of the frequency bands of the noiseless voice may become minimum. The weight coefficient of the noise suppressing apparatus in the embodiment of FIG. 12 can be set without the complicated calculation on the part of a user. According to the present embodiment, the error calculation marks can be downsampled, and the weight coefficient can be calculated with a short time period.

Figure 14A:
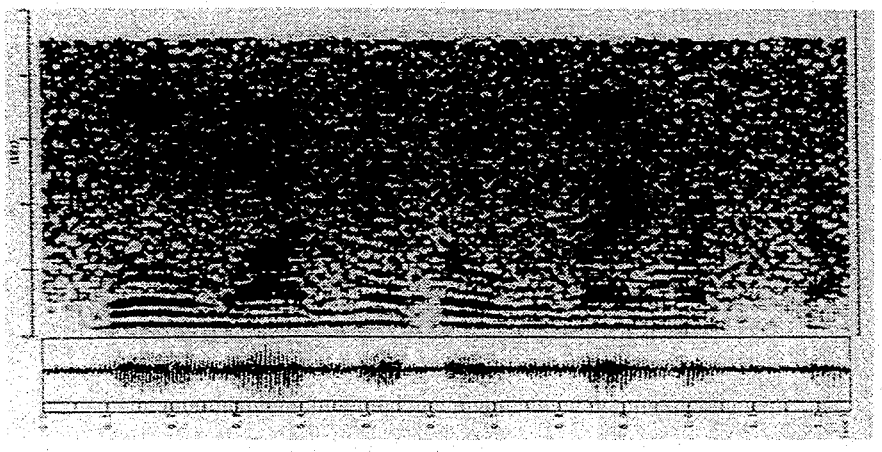
FIGS. 14(*a*)–(*b*) are views showing an example of a noise suppressing effect of a noise suppressing apparatus in the fifth embodiment adjusted by an adjusting method in the sixth embodiment.
Figure 14B:
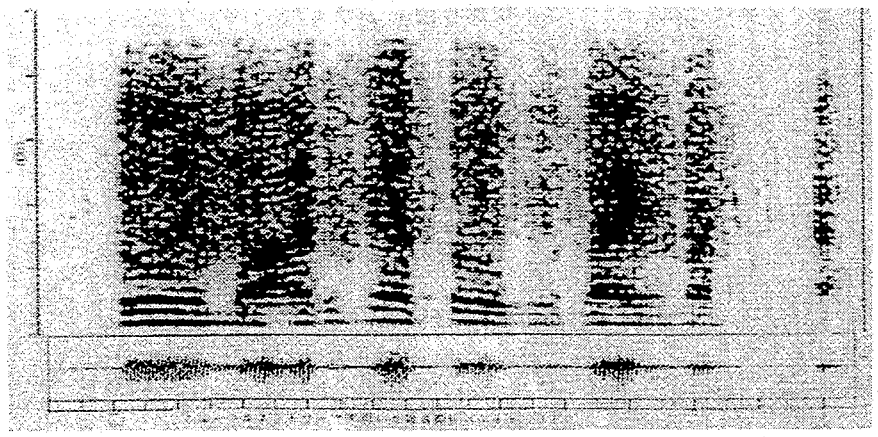

An example of the noise suppressing effect of the noise suppressing apparatus in FIG. 12 embodiment adjusted with the adjusting method of FIG. 13 embodiment is shown in FIG. 14. FIG. 14(*a*), (*b*) are respectively a time waveform and a spectrogram of a Japanese word voice before and after the processing. White noises are piled up with the S/N=6 dB upon the signal before the processing, and the noises are piled up so that it may become the S/N ratio 6 dB upon the voice data of 20 words having a vocal sound distribution equivalent to vocal sounds of 5120 words in Japanese important words at the decision time of the weight coefficient so as to provide the input signal. As compared with FIG. 14(*a*), (*b*), as is clear, the components of the voice buried in the noises of 2 kHz or more appear on the spectrogram clearly by the processing. As is clear from the time waveform, the noises are further suppressed as compared with the first embodiment shogun in FIG. 6. Such unnatural distortion as when the spectrum subtraction was used cannot be heard in the voice after the processing.

Figure 15:
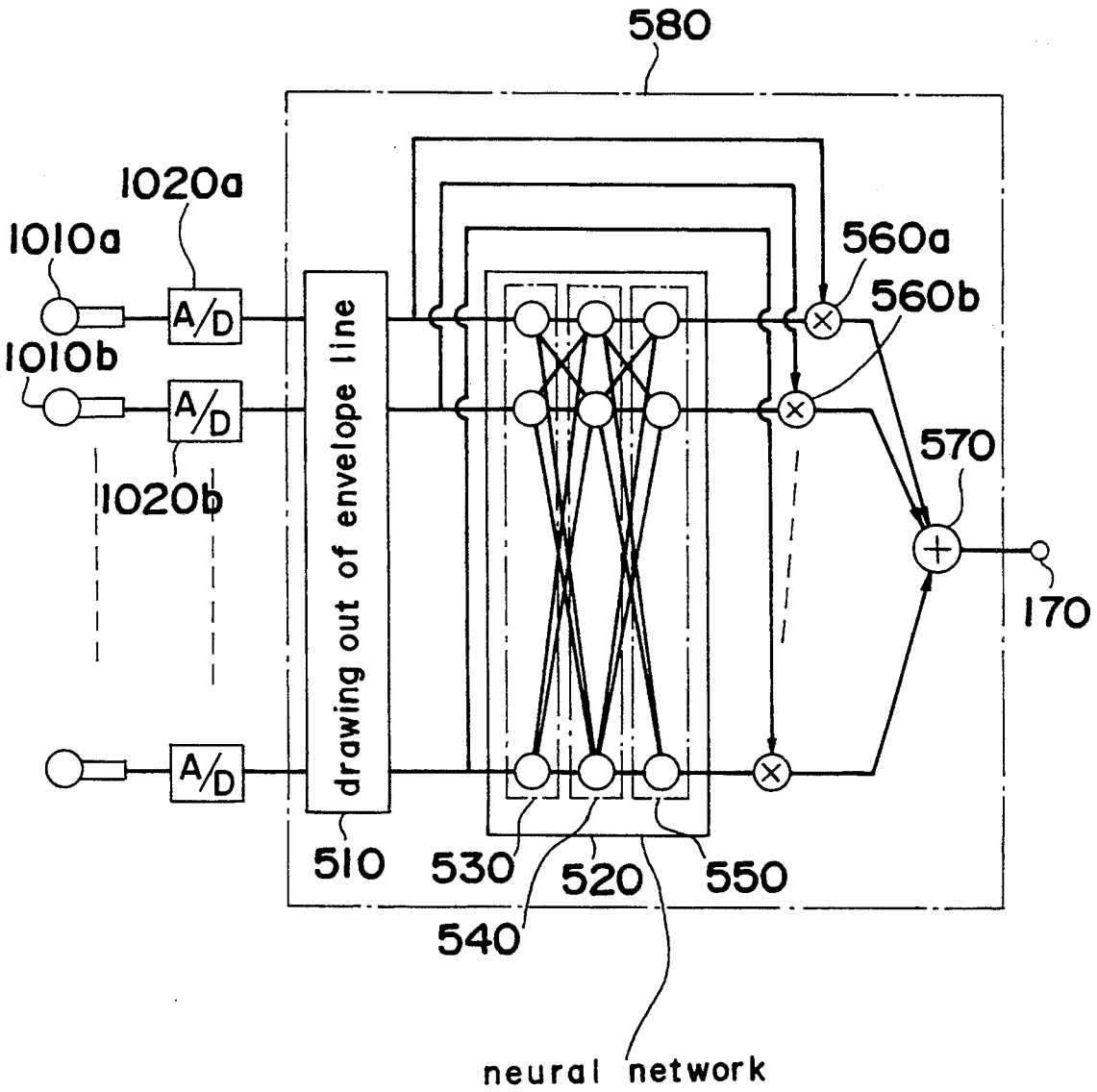
FIG. 15 is a block diagram showing the construction of a noise suppressing apparatus in a seventh embodiment of the present invention.

FIG. 15 shows a block diagram of a noise suppressing apparatus in the seventh embodiment of the present invention. The like parts in FIG. 15 are designated by like reference numerals in FIG. 9. Reference numeral 1000 is a signal input portion, reference numerals 1010*a*, 1010*b*, . . . are microphones, reference numerals 1020*a*, 1020*b*, . . . are A/D converters. Reference numeral 580 is a noise suppressing portion in FIG. 9. Reference numeral 510 is an wave detector for detecting the wave of each channel. Reference numeral 520 is a neutral network where the number of the respective units is the same in an input layer 530, a hidden layer 540, an output layer 550.

In a noise suppressing apparatus in the embodiment constructed as described hereinabove, noises are suppressed from the necessary voice with the use of the phase difference between the noise and the voice to be caused from the difference of the positions of microphones 1010*a*, 1020*b*, . . . The gain for each channel is determined by the neutral network to hear the voice and the noises are suppressed.

As described hereinabove, in the present embodiment, a noise suppressing apparatus is obtained where noises are suppressed and only the voices are taken out with a plurality of microphones, an envelope detector and the neutral network being combined.

Figure 16:
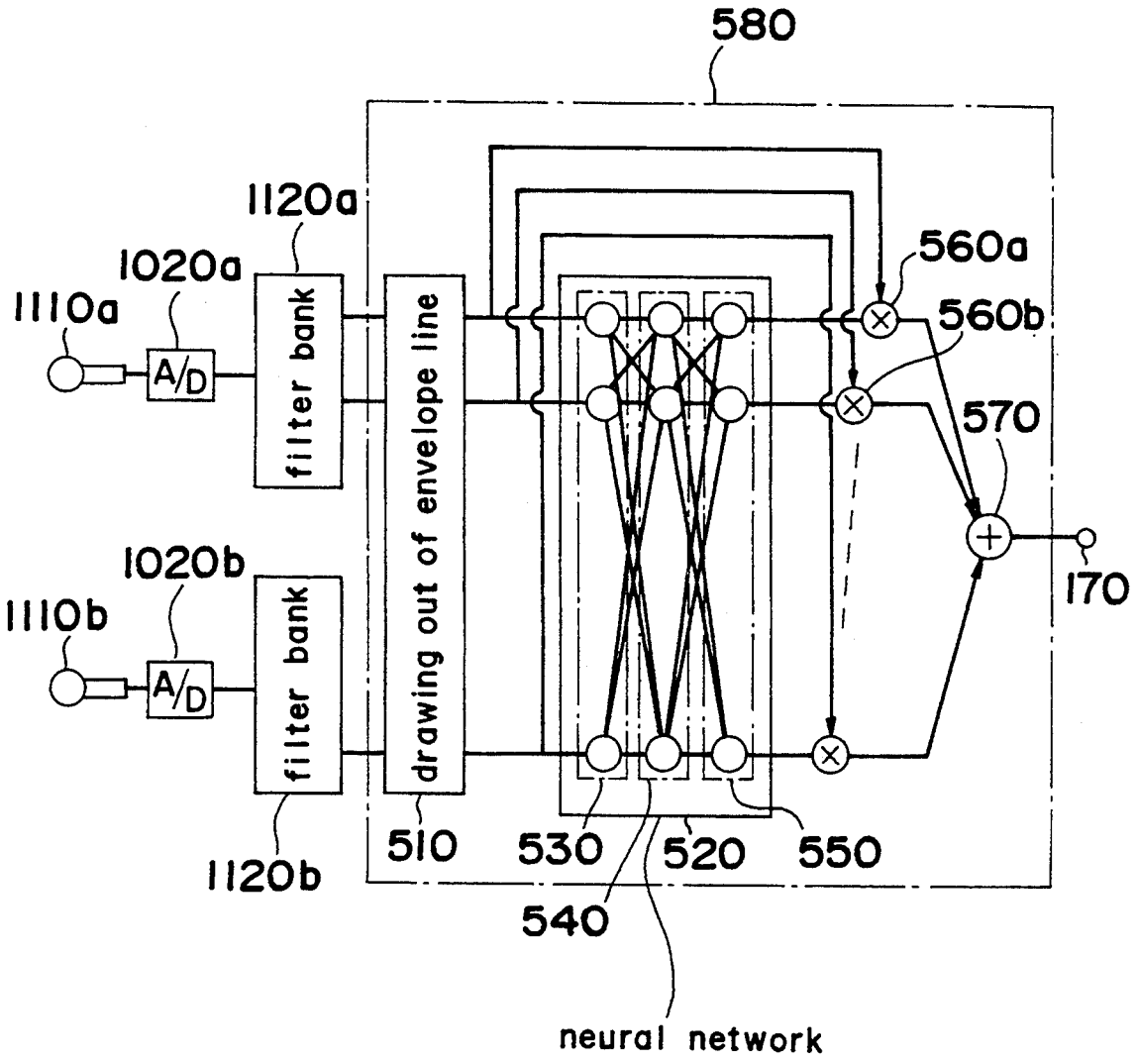
FIG. 16 is a block diagram showing the construction of a noise suppressing apparatus in an eighth embodiment of the present invention.

FIG. 16 shows a block diagram of a noise suppressing apparatus in the eighth embodiment of the present invention. Reference numeral 1100 is a signal input portion, reference numerals 1110*a*, 1110*b* are microphones, reference numerals 1020*a*, 1020*b* are A/D converters, reference numerals 1120*a*, 1120*b* are filter banks for dividing the signals into a plurality of frequency bands, reference numeral 550 is a noise suppressing portion in FIG. 9. Reference numeral 510 is an wave detector for detecting the wave of each channel. Reference numeral 520 is a neutral network where the number of the respective units is the same in an input layer 530, a hidden layer 540, an output layer 550.

In a noise suppressing apparatus of the embodiment constructed as described hereinabove, the gain for each channel is determined by the neutral network and the noises are suppressed with the use of the phase difference between the noises to be caused from the difference in the positions of the microphones 1010*a*, 1010*b* and the voice, and the difference of the energy distribution for each of the frequency frequency bands in each microphone.

As described hereinabove, in the present embodiment, a noise suppressing apparatus is obtained where noises are suppressed and only the voices are taken out with a plurality of microphones, a filter bank, an envelope detector and the neutral network being combined.

Figure 17:
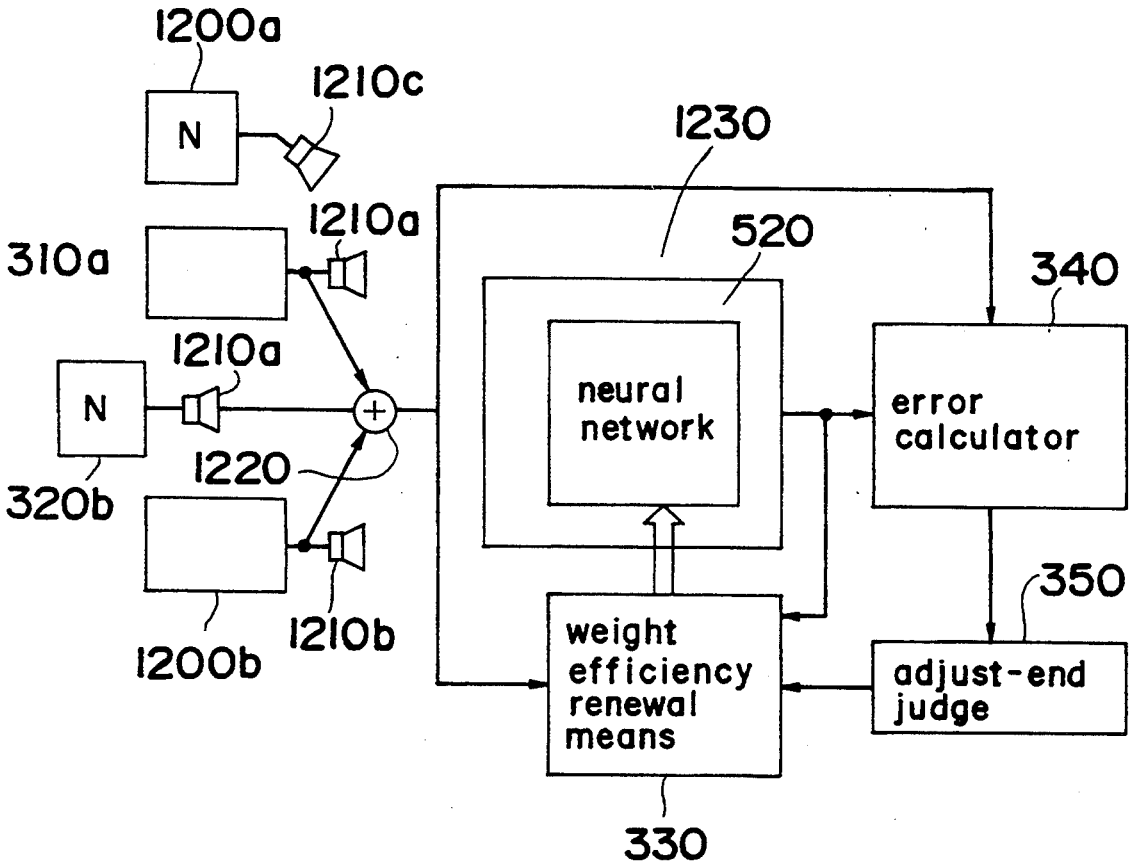
FIG. 17 is a block diagram showing the construction of the adjusting method of a noise suppressing apparatus in a ninth embodiment of the present invention.
Figure 18:
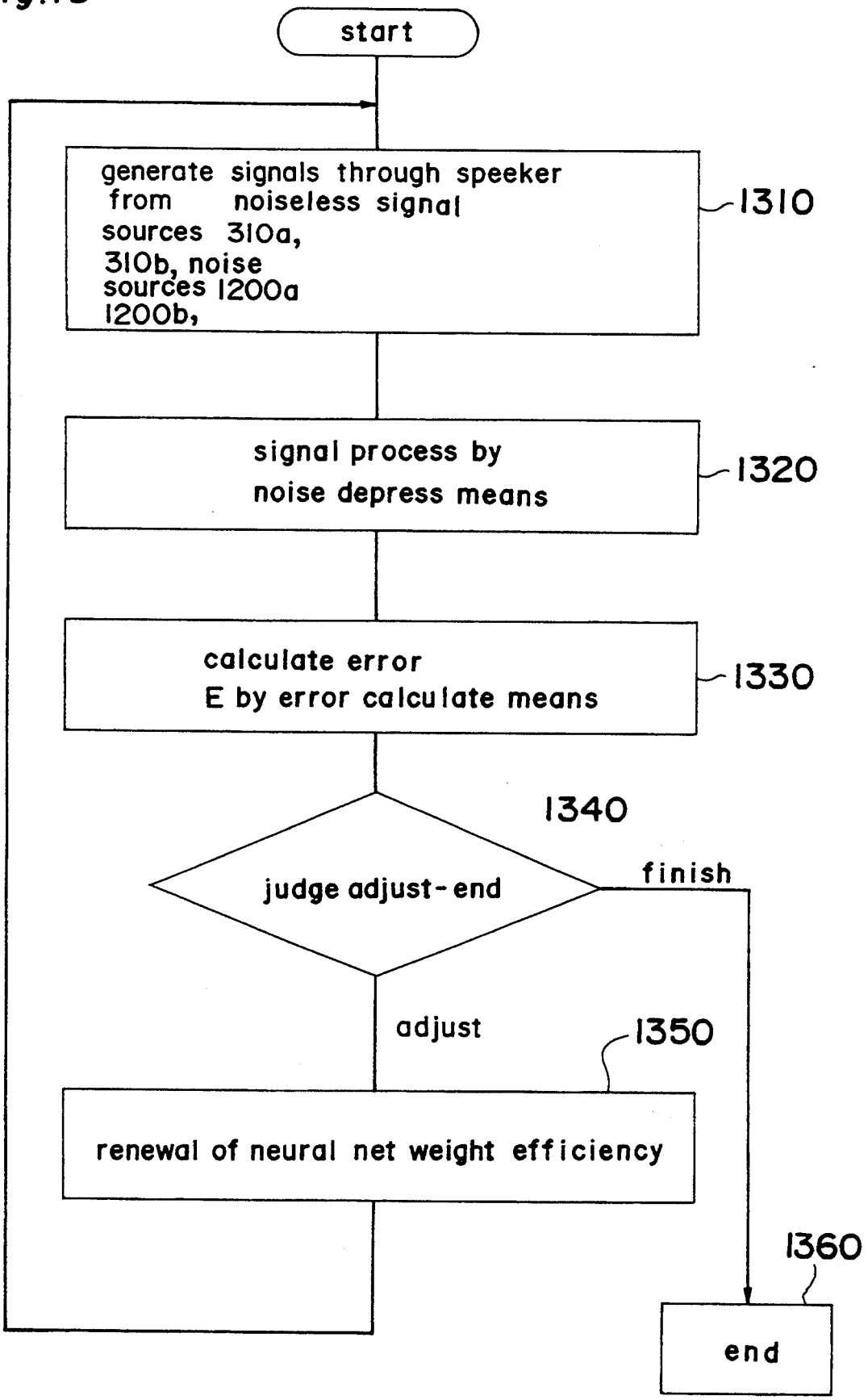
FIG. 18 is a block diagram showing the processing flow of an adjusting method of a noise suppressing apparatus in the ninth embodiment of the present invention.

FIG. 17 shows a block diagram of an adjusting method of a noise suppressing apparatus in the ninth embodiment of the present invention. FIG. 18 shows a flow chart of the processing. It is to be noted that like parts in FIG. 17 are designated by like reference numerals in FIG. 4. The present embodiment is an adjusting method of adjusting the weight coefficients of the neutral network of the noise suppressing apparatus of FIG. 15 and FIG. 16 in the actual use condition. Reference numerals 310*a*, 310*b* are respectively voice sources for generating the voice of the noiseless sound. Reference numerals 320*a*, 320*b* are noise sources for generating the noises which become the objects of the suppression, and are disposed respectively in the arrangement the same as in the practical use environment. The output signals of the voice sources 310*a*, 310*b*, noise sources 1200*a*, 1200*b* are generated as sounds from the A/D converter built in speakers 1210*a*, 1210*b*, 1210*c*, 1210*d*. Reference numeral 1220 is an adder, which adds the output signals of a plurality of noiseless sound signal sources so as to make ideal noiseless sound signals. Reference numeral 1230 is a noise suppressing apparatus in FIG. 15 or FIG. 16 which becomes an object of the adjustment. Reference numeral 520 is a neutral network to be included therein.

The flow of the processing will be described in accordance with FIG. 18 in the adjusting method of the present embodiment constructed as described hereinabove. The output signals of the voice sources 310*a*, 310*b*, the noise sources 1200*a*, 1200*b* are generated as sources from A/D transducer built in speakers 1210*a*, 1210*b*, 1210*c*, 1210*d* and the voice with noises being piled up on it as in practical use circumference is given to a noise suppressing apparatus 1230 (1310). The weight coefficient of the neutral network 520 of the noise suppressing apparatus is set to a proper initial value, and the voice with noises being piled up in it is processed with the use of the weight coefficient so as to obtain the output signal 0 (t) (1320). The error means 340 calculates such an error E as shown in the embodiment of FIG. 4 with the use of the output signal of the noise suppressing apparatus 300 and the voice of the noiseless voice so as to transfer it to the adjustment completion judging means 350 (1330). The judgment is effected by the adjustment completion judging means (1340). When the completion has been judged, the judgment is completed (1360). In a case except for it, the new weight coefficient is generated in the weight coefficient renewing means 330 so as to transfer it to the neutral network 130 of the noise suppressing apparatus 300 (1350). Hereinafter, the adjustment completion judging means repeats the above described operation from the error computation result to the judgment of the adjustment completion.

In the present embodiment, the voices with the noises being piled up on them in the actual use circumference are converted, are inputted into the noise suppressing apparatus so as to determine the weight coefficients of the neutral network of the noise suppressing apparatus with the back propagation method as the noiseless sound voice as a target. The weight coefficient of the noise suppressing apparatus in the embodiments of FIG. 15, FIG. 16 can be set without the complicated calculation on the part of a user.

Figure 19:
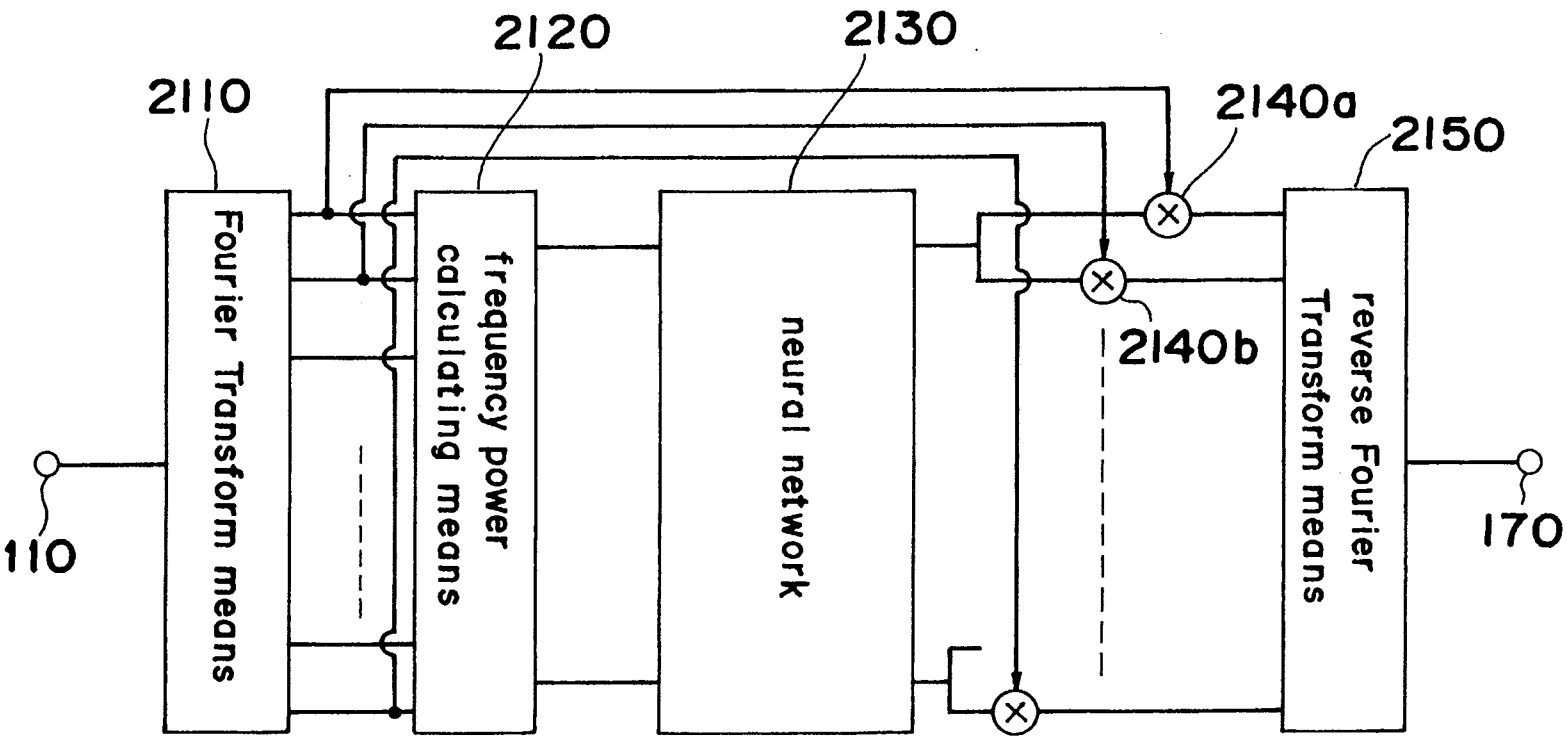
FIG. 19 is a block diagram showing the construction of an adjusting method of a noise suppressing apparatus in a tenth embodiment of the present invention.

FIG. 19 shows a block diagram of a noise suppressing apparatus in the tenth embodiment of the present invention. It is to be noted that like parts in FIG. 19 are designated by like reference numerals in the other drawings. Reference numeral 110 is an input terminal.

Reference numeral 170 is an output terminal. Reference numeral 2110 is a N point fourier converting means for converting the input signals into N number of complex spectra, reference numeral 2120 is a power calculating means for calculating the power of each frequency from the real part . imaginary part of each frequency. Neutral network 2130 is a feed forward type of neutral network of N unit in an input layer, N unit in a hidden layer, N unit in an output layer. Reference numerals 2140*a*, 2140*b*, . . . are multipliers, reference numeral 2150 is an inverse fourier converting means.

The noise suppressing apparatus in the embodiment constructed as described hereinabove will be described hereinafter in its operation. The input signal inputted into the input terminal 110 is extracted in the power of each frequency by a N point fourier converting means 2110, a power calculating means 2120. The neutral network 2130 represents the power information on the gain necessary for each frequency band so as to suppress the noises for outputting it. The gain of each frequency band outputted from the neutral network is multiplied with the signal of each frequency band by the multipliers 2140*a*, 2140*b* so as to obtain the complex spectra of the estimated noiseless signal. The estimated noiseless signal is converted into a time series signal by the reverse fourier converting means 2150.

In order to decide the coefficient of the neutral network 2130 of the noise suppressing apparatus of FIG. 19, an adjusting method of a noise suppressing apparatus provided with the fourier converting means 2110 and the power calculating means 2120, instead of the filter banks 120*a*, 120*b*, the wave detectors 510*a*, 510*b* in FIG. 10 has only to be used.

Figure 20:
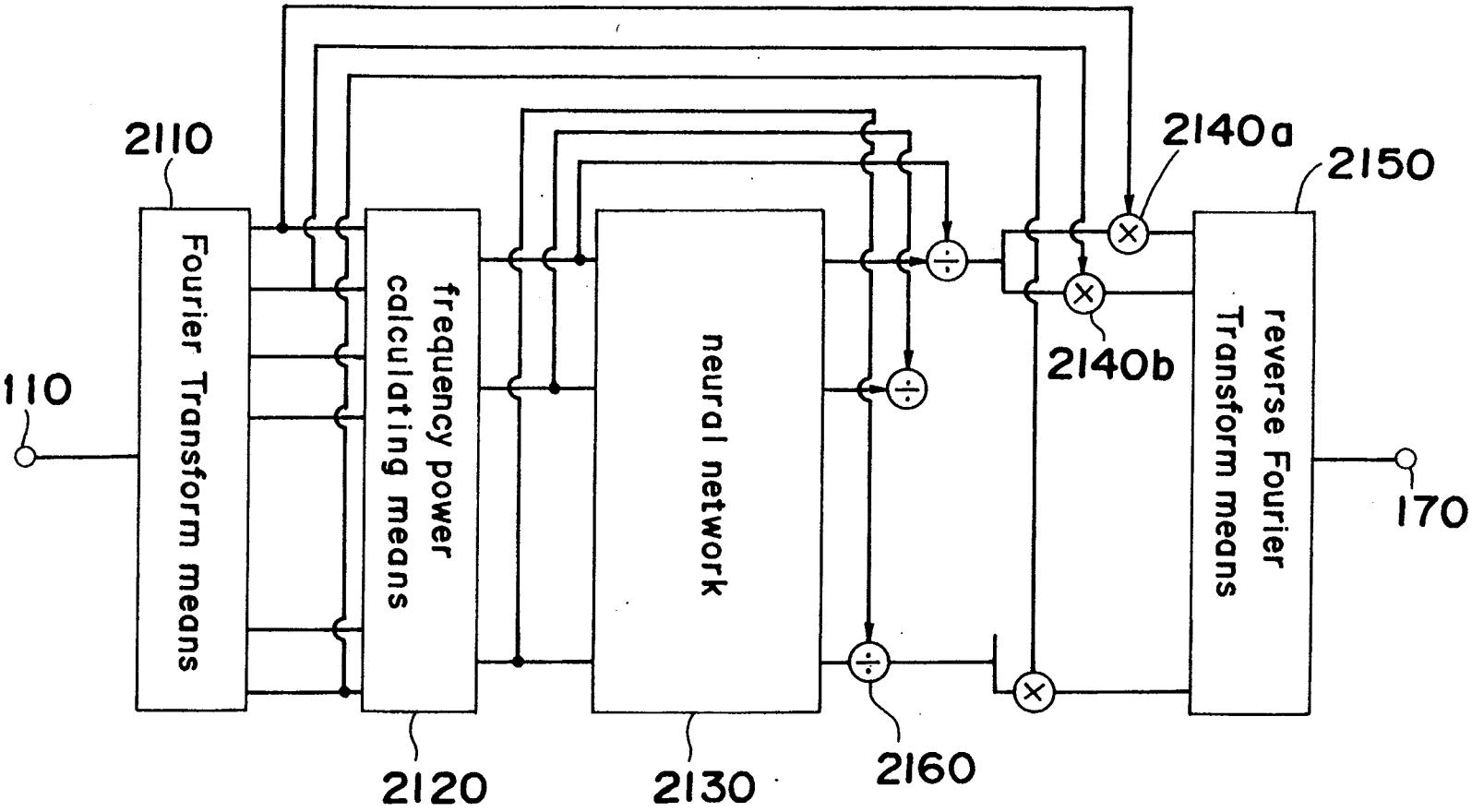
FIG. 20 is a block diagram showing the construction of an adjusting method of a noise suppressing apparatus in an eleventh embodiment of the present invention.
Figure 21:
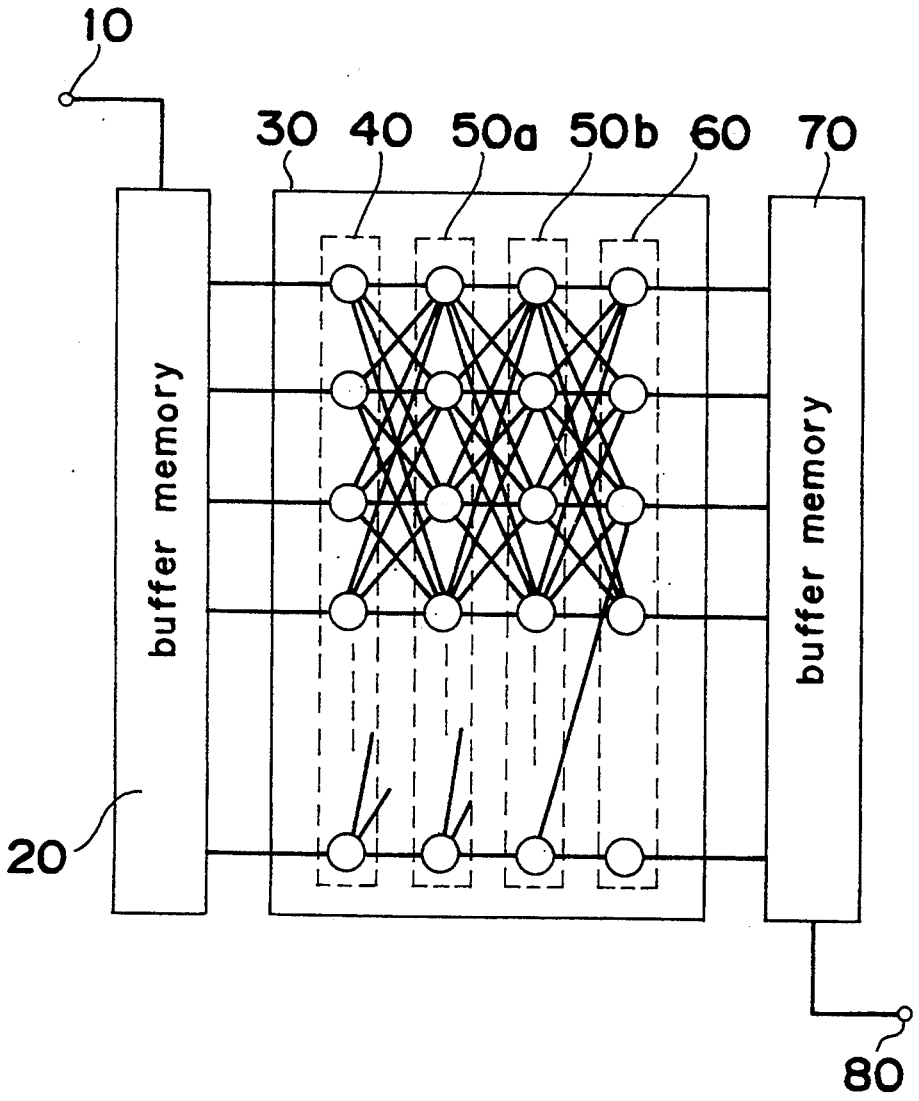
Fig. 21 PRIOR ART
FIG. 21 is a block diagram showing the construction of the conventional noise suppressing apparatus.

FIG. 20 shows a block diagram of a noise suppressing apparatus in the eleventh embodiment of the present invention. It is to be noted that like parts in FIG. 20 are designated by like reference numerals in the other drawings. FIG. 20 is different from the FIG. 19 in that the gain of each frequency band is obtained by the division of the output signal of the neutral network 2130 by a signal after the wave detection of each frequency band.

In the noise suppressing apparatus in the embodiment constructed as described hereinabove, the neutral network 2130 has a function of representing the power of each frequency for each of the frequency bands of the voice with the noises being piled up in it on the power of each frequency of the noiseless voice. In this case, the load of the neutral network becomes smaller as compared with the embodiment of FIG. 19 where the envelope information is represented on the gain of the each frequency band so as to positively suppress the noises. The noise suppressing apparatus is easier to realize as the operation amount is less because of the frame processing.

In order to decide the coefficient of the neutral network 2130 of the noise suppressing apparatus of FIG. 20, an adjusting method of a noise suppressing apparatus provided with a fourier converting means 2120 and a power calculating means 2120, instead of the filter banks 120*a*, 120*b*, the wave detection 510*a*, 510*b* in FIG. 11, has only to be used.

According to the present embodiment, a noise suppressing apparatus can be obtained where the weight coefficient determination of the neutral network can be effected with a short time, the load of the neutral network itself is small, and the operation amount is less.

FFT, filter banks of the other characteristics, instead of 31 channel auditor filter banks 120, 120*a*, 120*b*, may be used in the embodiment of FIG. 1, FIG. 9, FIG. 10, FIG. 12 and FIG. 13. An auditor filter bank different in the channel number may be used. In FIG. 1, the unit of the input layer 140 of the neutral network 130 may be either in number if it is equal to the channel number of the filter. The unit number of the hidden layer of the neutral network 130 in the embodiment of FIG. 1, and the unit number of the hidden layer of the neutral network 520 in the respective embodiment of FIG. 9, FIG. 10, FIG. 12 and FIG. 13 may be respectively either. The neutral network 130 of the embodiment of FIG. 1 or the noise suppressing portion 720 of FIG. 12, instead of the noise suppressing portion 550 in the embodiment of FIG. 15, FIG. 16, may be used. Although the voice input portion 1100 of two mikes in the embodiment of FIG. 14 is used, two microphones or more may be used. In all the embodiments, it is needless to say that all the construction block or one portion construction block may be composed of software, instead of hardware.

As is clear from the foregoing description, according to the arrangement of the present invention, a noise suppressing apparatus where the noises are suppressed even in such a situation as the positional relationship between the noise source and the voice source often changes, a noise suppressing apparatus where noises offensive to the voice after the noise suppression do not remain, a noise suppressing apparatus where the suppressing effect is not deteriorated even if the time pattern of the input signal is varied.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A noise suppressing apparatus comprising:

one channel of voice and additional noise;

frequency band dividing means for dividing an input signal from only said one channel with voice and additional noise into a plurality of frequency bands with each frequency band including a voice component and an additional noise component within the respective frequency band of the input signal;

a neural network, having weight coefficients to emphasize voice and suppress noise, including an input layer having a plurality of units connected with the frequency band dividing means, a hidden layer having a plurality of units connected with the input layer units, and an output layer of a single unit connected with the hidden layer units, wherein output signals with noises being suppressed are obtained from the single unit of the output layer.

2. A noise suppressing apparatus comprising:

one channel of voice and additional noise;

frequency band dividing means for dividing into a plurality of frequency bands an input signal from only said one channel with voice and additional noise with each frequency band including a voice component and an additional noise component within the respective frequency band of the input signal;

wave detecting means for outputting an envelope of each of the frequency bands;

a neural network, having weight coefficients to emphasize voice and suppress noise, including an input layer having a plurality of units connected with the wave detecting means, a hidden layer having a plurality of units being connected with the plurality of input layer units, and an output layer composed of units equal in number to the input layer and being connected with the plurality hidden layer units, each unit in the output layer produces an output signal;

means for obtaining a plurality of respective products of the output signals of each output layer by the frequency bands, means for calculating a total of the plurality of products, wherein the total is outputted as an output signal with noise being suppressed.

3. A noise suppressing apparatus comprising:

one channel with voice and additional noise:

frequency band dividing means for dividing into a plurality of frequency bands an input signal from only said one channel with voice and additional noises with each frequency band including a voice component and an additional noise component within the respective frequency band of the input signal;

wave detecting means for outputting an envelope of each of the frequency bands, the wave detecting means produces a plurality of output signals;

neural network, having weight coefficients to emphasize voice and suppress noise, including an input layer having a plurality of units connected with the wave detecting means, a hidden layer having a plurality of units connected with the plurality of input layer units, and an output layer having units equal in number to the plurality of input layer units and connected with the plurality hidden layer units, means for dividing, for each frequency band, the output signal of the output layer units by the output signal of the wave detecting means, and producing outputs;

means for calculating a product of the outputs of the means for dividing by the frequency bands, means for calculating a total of all the products, wherein the total is outputted as an output signal with the noises being suppressed.

4. An adjusting method of a noise suppressing apparatus including a noiseless sound signal generating means for generating noiseless sound signals, a noise addition means for adding the noises on the noiseless sound signals, a first frequency band dividing means the same in construction as the noise suppressing apparatus described in the claim 3 with the output signal of the noise addition means being an input signal, a first wave detecting means and a neural network, a second frequency band dividing means for dividing into a plurality of frequency bands the noiseless sound signal, a second wave detecting means for outputting the envelope of the respective output signals of each of the second frequency band dividing means, a weight coefficient renewing means for renewing the weight coefficients of the neural network with a back propagating method so that the average difference between the output signal of the neutral network and the teacher signal may become smaller with the output signal of the second wave detecting means being made a teacher signal input, an error computing means for calculating, outputting the average error between the output signal of the above described second wave detecting means and the output signal of the first wave detecting means, an adjustment completion judging means for suspending the operation of the weight coefficient renewing means when the computed error has been lower than the set threshold value or when the reduction in the error has been focused, comprising the steps of repeating, to the judgment of the adjustment completion by the adjustment completion judging means, of generating of the noiseless sound signal by the noiseless sound signal source, adding the noises onto the noiseless sound signal by the noise addition means, calculating by the respective frequency band dividing means, the wave detecting means, the neutral network, and the multiplying mean, calculating of the error by the error calculating means, judging by the adjustment completion judging means, renewing of the weight coefficient by the weight coefficient renewing means so as to make the weight coefficient of the neutral network optimum at the adjustment completion.

5. A noise suppressing apparatus comprising:

a plurality of microphones for producing time signals; and a neural network, having weight coefficients to emphasize voice and suppress noise, including an input layer having a plurality of units for receiving time signals from the plurality of microphones, a hidden layer having a plurality of units connected with the plurality of input layer units, and an output layer of single unit connected with the hidden layer units, wherein an output signal whose noises are suppressed is obtained from the single unit of the output layer.

6. A noise suppressing apparatus comprising:

a plurality of microphones which produce outputs, wave detecting means for outputting an envelope of each output signal of the microphones, the wave detecting means producing a plurality of outputs;

a neural network, having weight coefficients to emphasize voice and suppress noise, including an input layer having a plurality of units connected with the wave detecting means, a hidden layer having a plurality of units connected with the plurality of input layer units, and an output layer having units equal in number to the plurality of input layer units and connected with the plurality of hidden layer units, means for calculating, for each of the microphones, a product of the output signals of the neural network by the output signals of the wave detecting means, means for calculating a total of the products, wherein the total is outputted as a signal whose noises are suppressed.

7. A noise suppressing apparatus comprising:

a plurality of microphones which product output signals, wave detecting means for outputting an envelope of each output signal of the microphones, the wave detecting means producing a plurality of outputs;

a neural network, having weight coefficients to emphasize voice and suppress noise, including an input layer having a plurality of units connected with the wave detecting means, a hidden layer having a plurality of units connected with the plurality of input layer units, and an output layer having units equal in number to the plurality of input layer units and connected with the plurality of hidden layer units, means for dividing, for each of corresponding signals, by the output signals of the wave detecting means, the output signals of the neural network, means for calculating a product of each result of the division by the output signal of the wave detecting means, means for calculating a total of the products, wherein the total is outputted as an output signal whose noises are suppressed.

8. A noise suppressing apparatus comprising:

a plurality of microphones, a frequency band dividing means connected with the microphones, the frequency band dividing means producing a plurality of output signals;

a neural network, having weight coefficients to emphasize voice and suppress noise, including an input layer having a plurality of units connected with the output terminals of the frequency band dividing means, a hidden layer having a plurality of units connected with the plurality of input layer units, and an output layer of a single unit connected with the hidden layer units, wherein output signals in which noises are suppressed are output by the single unit of the output layer.

9. A noise suppressing apparatus comprising:

a plurality of microphones, a plurality of frequency band dividing means connected respectively with the microphones and producing output signals, wave detecting means, having a plurality of output signals, for outputting an envelope of each output signal of the frequency band dividing means, a neural network, having weight coefficients to emphasize voice and suppress noise, including an input layer having a plurality of units connected with the wave detecting means, a hidden layer having a plurality of units connected with the plurality of input layer units, and an output layer having units equal in number to the plurality of input layer units and connected with the plurality of hidden layer units, means for obtaining, for each of the frequency bands, a product of the output signals of the neural network by the output signals of the frequency band dividing means, means for calculating a total of the products, wherein the total is outputted as an output signal whose noises are suppressed.

10. A noise suppressing apparatus comprising:

a plurality of microphones, a plurality of frequency band dividing means connected with the microphones and for producing output signals, a plurality of wave detecting means equal in number to the plurality of frequency band dividing means, a neural network, having weight coefficients to emphasize voice and suppress noise, including an input layer having a plurality of units connected with the plurality of wave detecting means, a hidden layer having a plurality of units connected with the plurality of input layer units, and an output layer having units equal in number to the plurality of input layer units and connected with the plurality of hidden layer units, means for dividing by each output signal of the wave detecting means, the output signals of the neural network, means for calculating a product of the results of the division by the output signals of the plurality of frequency band dividing means, means for calculating a total of the products, wherein the total is outputted as an output signal whose noises are suppressed.

11. An adjusting method of a noise suppressing apparatus including noise sources and noiseless sound signal sources disposed as in the actual use circumference, a means for extracting only the signals of the noiseless sound signal sources, a noise suppressing apparatus described in one of the claims 5, 6, 7, 8, 9, 10, a weight coefficient renewing means for renewing the weight coefficients of the neural network having the noise suppressing apparatus with a back propagation method so that the average difference between the output signal of the noise suppressing apparatus and the teacher signal may become smaller, with the output signal of the noiseless sound signal generating means being provided as the teacher signal input, an error computing means for calculating and outputting the average error between the output signal of the noise suppressing apparatus and the output signal of the noiseless sound signal extracting means, an adjustment completion judging means for suspending the operation of the weight coefficient renewing means when the computed error has been lower than the set threshold value or when a reduction in the error has been focused, comprising the steps, to the judgment of the adjustment completion by the adjustment completion judging means, generating of the signals by the noiseless sound sources, processing of the signals by the noise suppressing means, calculating of the error by the error computing means, judging by the adjustment completion judging means, renewing of the weight coefficient by the weight coefficient renewing means so as to make optimum the weight coefficients of the neural network at the adjustment completion.

12. An adjusting method of a noise suppressing apparatus including a noiseless sound signal generating means for generating noiseless sound signals, a noise addition means for adding the noises on the noiseless sound signals, a first frequency band dividing means with the output signal of the noise addition means being input signal, a first wave detecting means and a neutral network, a second frequency band dividing means for dividing into a plurality of frequency bands the noiseless sound signal, a second wave detecting means for outputting an envelope of the respective output signals of each of the second frequency band dividing means signals, a weight coefficient renewing means for renewing the weight coefficients of the neural network with a back propagating method so that the average difference between the output signal of the neutral network and the teacher signal may become smaller with the output signal of the second wave detecting means being provided as the teacher signal input, an error computing means for calculating and outputting the average error between the output signal of the second wave detecting means and the output signal of the first wave detecting means, an adjustment completion judging means for suspending the operation of the weight coefficient renewing means when the computed error has been lower than the set threshold value or when the reduction in the error has been focused, comprising the steps of repeating, to a judgment of the adjustment completion by the adjustment completion judging means, generating of the noiseless sound signal by the noiseless sound signal source, piling up of noises onto the noiseless sound signal by the noise addition means, processing by the frequency band dividing means, the wave detecting means, and the neutral network, calculating of the error by the error calculating means, judging by the adjustment completion judging means, renewing of the weight coefficient by the weight coefficient renewing means so as to make optimum the weight coefficients of the neural network at the adjustment completion.

13. A noise suppressing apparatus comprising:

means for calculating spectrum of input signal;

a feed forward neural network, having weighting coefficients which emphasize voice and suppress noise, having at least three layers including an input layer having a plurality of units which are inputted magnitude of each frequency spectrum value;

a hidden layer having a plurality of units connected with the plurality of input layer units;

an output layer having units equal in number to the input layer units connected with the plurality of hidden layer units and producing an output;

means for multiplying the respective spectrum and the output of the output layer of the neural network; and means for calculating time region signal from the output of the means for multiplying, wherein the output signal of the means for calculating time region signal is outputted as an output signal.

14. A noise suppressing apparatus comprising:

means for calculating spectrum of an input signal;

a feed forward neural network, having weighting coefficients which emphasize voice and suppress noise, with at least three layers including an input layer having a plurality of units which are inputted each frequency spectrum value calculated by means for calculating spectrum;

a hidden layer having a plurality of units connected with the plurality of input layer units;

an output layer having units equal in number to the input layer units and connected with the plurality of hidden layer units; and means for calculating time region signals from spectrum using data from the output layer of the neural network;

wherein the output signal of the means for calculating time region signal is outputted as an output signal.

* * * * *